US011341815B2

(12) United States Patent
Oberberger et al.

(10) Patent No.: US 11,341,815 B2
(45) Date of Patent: May 24, 2022

(54) SKILLFULL REGULATED MULTI-LEVEL CASINO GAMES AND GAMING MACHINES CONFIGURED TO ENCOURAGE EXPLORATION OF GAME STAGES, SCENARIOS, LEVELS AND AREAS

(71) Applicant: AKKADIAN ENTERPRISES, Las Vegas, NV (US)

(72) Inventors: Michael M Oberberger, Spring Hill, TN (US); Michael M Low, Henderson, NV (US)

(73) Assignee: AKKADIAN ENTERPRISES, Las Vegas, NV (US)

( * ) Notice: Subject to any disclaimer, the term of this patent is extended or adjusted under 35 U.S.C. 154(b) by 0 days.

(21) Appl. No.: 17/036,427

(22) Filed: Sep. 29, 2020

(65) Prior Publication Data

US 2021/0110649 A1 Apr. 15, 2021

Related U.S. Application Data

(63) Continuation of application No. 16/541,697, filed on Aug. 15, 2019, now Pat. No. 10,991,202, which is a (Continued)

(51) Int. Cl.
*G07F 17/32* (2006.01)

(52) U.S. Cl.
CPC ..... *G07F 17/3244* (2013.01); *G07F 17/3211* (2013.01)

(58) Field of Classification Search
CPC ..... G07F 17/3244; G07F 17/3211
See application file for complete search history.

(56) References Cited

U.S. PATENT DOCUMENTS 6,062,980 A * 5/2000 Luciano ..... G07F 17/3244 273/138.2
6,443,837 B1 * 9/2002 Jaffe ..... G07F 17/32 463/16

(Continued)

OTHER PUBLICATIONS

International Search Report and Written Opinion of the International Searching Authority dated Nov. 24, 2020 in PCT/US20/45783, 12 pages.

*Primary Examiner* — Steve Rowland
(74) *Attorney, Agent, or Firm* — Lewis Roca Rothgerber Christie LLP

(57) ABSTRACT

A computer-implemented method may comprise providing a wager-based electronic gaming device (EGD) comprising at least one processor, memory, a display, an input interface and a money acceptor. The EGD may be configured to accept money from a player via the money acceptor and establish an account balance using the received money; display a game environment configured to enable the player to participate, via the input interface, in a gaming session of a wager-based game comprising a plurality of stages, and enable, for the gaming session, game play and wagers in a current stage of the plurality of stages of the wager-based game. It may then be determined that game play in the current stage has reached a current stage complete state in which all requirements necessary for transitioning game play from the current stage to a next or other stage of the plurality of stages have been met. Thereafter, it may be determined whether the game play transitions from the current stage to the next or other stage or remains at or returns to the current stage. When game play transitions from the current stage to the next or other stage of the plurality of stages, a Return-To-Player (RTP) of the wager-based game may be increased (or maintained the same) and when game play remains at or returns to the current stage (Continued)

after the current stage complete state is reached, the RTP of the wager-based game may at least temporarily be decreased or maintained unchanged.

8 Claims, 22 Drawing Sheets

Related U.S. Application Data continuation of application No. 16/506,744, filed on Jul. 9, 2019, now Pat. No. 10,991,206, which is a continuation of application No. 16/153,813, filed on Oct. 7, 2018, now Pat. No. 10,720,018.

(56) References Cited

U.S. PATENT DOCUMENTS 6,612,927 B1* 9/2003 Slomiany ..... G07F 17/3244 463/13
2002/0160827 A1* 10/2002 Slomiany ..... G07F 17/3244 463/16
2005/0037828 A1* 2/2005 Baerlocher ..... G07F 17/3211 463/16
2007/0235933 A1* 10/2007 Cowan ..... G07F 17/32 273/269
2008/0039191 A1* 2/2008 Cuddy ..... G07F 17/3258 463/25
2008/0227537 A1* 9/2008 Hall ..... G07F 17/3267 463/25
2009/0124334 A1* 5/2009 Jones ..... G07F 17/32 463/20
2009/0156294 A1* 6/2009 Berkowitz ..... G07F 17/3244 463/20
2009/0254430 A1* 10/2009 Cherenson ..... G06Q 30/0254 705/14.12
2011/0111824 A1* 5/2011 Cuddy ..... G07F 17/3213 463/20
2013/0130769 A1* 5/2013 Taylor ..... G07F 17/3267 463/20
2014/0302909 A1* 10/2014 Meyer ..... G07F 17/34 463/20
2015/0011301 A1* 1/2015 Cardno ..... G07F 17/34 463/25
2015/0379822 A1* 12/2015 Ellis ..... G07F 17/3267 463/23
2019/0096193 A1 3/2019 Hirai et al.

* cited by examiner

SKILLFULL REGULATED MULTI-LEVEL CASINO GAMES AND GAMING MACHINES CONFIGURED TO ENCOURAGE EXPLORATION OF GAME STAGES, SCENARIOS, LEVELS AND AREAS

BACKGROUND

Contemporary regulated casino games are often complex games, with multiple levels, stages and area, often featuring richly textured worlds and engaging action. However, some players tend to perseverate at a favorite level, in a preferred area or a familiar stage. They are familiar with the actions required and content themselves staying in familiar territory. The embodiments shown and described herein address this issue, thereby encouraging players to take advantage of the game's full potential.

BRIEF DESCRIPTION OF THE DRAWINGS

FIG. 23 also shows exemplary tangible, non-transitory computer-readable media having data stored thereon representing sequences of instructions which, when executed by the regulated gaming computing device, cause the regulated gaming computing device to operate according to an embodiment.

DETAILED DESCRIPTION

Figure 1:
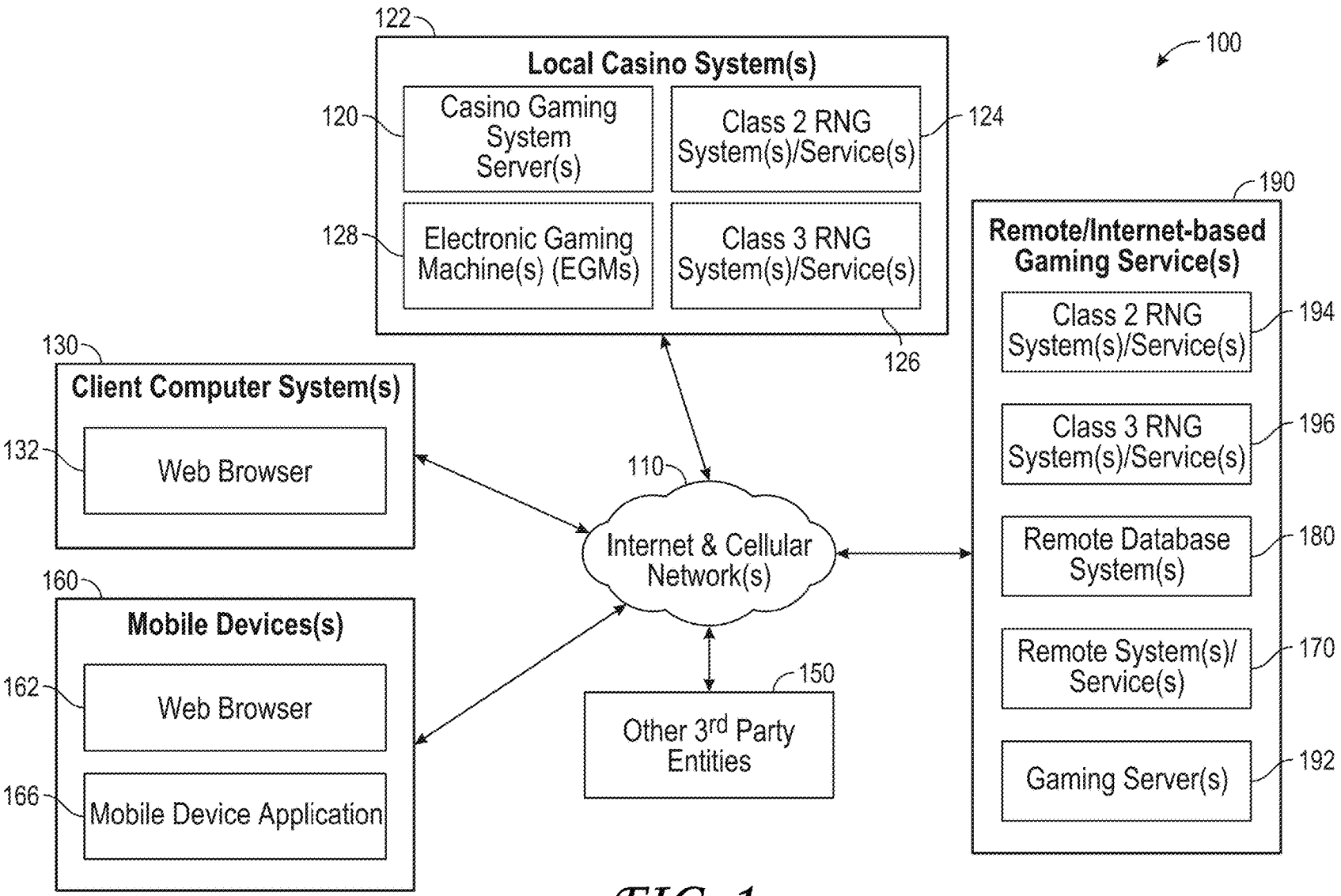
FIG. 1 illustrates a block diagram of a gaming network suitable for implementing embodiments.

Veteran gamblers (e.g., older gambler demographic age 50+) have been accustomed to a standard set of video gaming symbols (e.g., A, J, K, Q from playing cards) which, for example, may be accompanied with a multitude of additional themed symbols (e.g., fruits, animals, fantasy creatures, media personas, etc.) presented on a series of wheels or drums. Newer technology has made possible the use of digital display screens that present the reels and symbols in a digital format. Such existing slot machine technology, however, is dated and may be unappealing to younger players. Indeed, younger gamblers (e.g., also referred to as "gamers"), on the other hand, are accustomed to home gaming consoles (Nintendo, XBOX, PlayStation and the like) that provide them with exquisitely-rendered immersive 2D & 3D game environments with which they can interact. These gamers, who are used to fast paced, energetic, and visually stunning games, feel that the display method of the traditional slot machines are unappealing, which leads to decreased revenue for casino operators.

It is desirable, therefore, to offer hybrid arcade/wager-based games or gambling arcade games that provide hybrid arcade-style, wager-based gaming techniques, which find a ready demographic in younger gamers. However, one significant obstacle regarding such hybrid arcade-style, wager-based gaming techniques is that they often rely on complex back end solutions that require lengthy and costly processes of regulatory review and approvals in many different gaming jurisdictions.

One possible workaround to this significant obstacle is to configure/design a hybrid arcade-style, wager-based game such that it is compliant with currently approved wager-based gaming regulatory standards such as, for example, the well-known GLI standards, which have already been approved in various gaming jurisdictions. One example of a GLI standard is the GLI-11 standard version 3.0, Published Sep. 21, 2016 by Gaming Laboratories International, LLC, which is incorporated herein by reference.

For example, in one embodiment, a hybrid arcade-style, wager-based game may be configured to provide an arcade-style gaming interface which enables a player to participate in an arcade-style game at the wager-based gaming machine. One or more events and/or activities performed by the player (e.g., during play of the arcade-style game) may automatically trigger a random number generator (RNG)-based wager that is compliant with applicable gaming standards, rules and regulations. Because such wager-based activities comply with currently existing GLI standard(s) (and/or other national, regional, local gaming rules and regulations), such hybrid arcade-style, wager-based games may not require additional regulatory approval for deployment in casino venues.

In one embodiment, a hybrid arcade-style, wager-based game may be created by combining a new and different visual game representation with a new and different method of player interaction. The hybrid arcade-style, wager-based game may be configured to provide a perceptually stimulating experience using a wide variety of human interface devices (HID), based on the theme/style of the gambling game at hand. For example, some games may utilize a gun controller for first person shooter games, or steering wheels, accelerator and brake pedals for driving games. These and other types of games and interactions may be adapted for hybrid arcade/wager-based gaming.

For example, the format of the hybrid arcade-style, wager-based game may also focus on other types of video and/or arcade-style games such as, for example, non-linear (e.g., open world) type video and/or arcade-style games such as, for example, Grand Theft Auto, linear type video and/or arcade-style games such as, for example, Half-Life, massively multiplayer online "MMO" type video and/or arcade-style games such as, for example, World of Warcraft, role-playing game "RPG" type video and/or arcade-style games such as, for example, Final Fantasy, and/or others, Such games may feature a player character that may be moved through the game world via player input, (e.g., HID), which allows for an increased sense of excitement through gameplay by providing a multitude of player-choice possibilities through a wide-array of path directions.

In some embodiments, the format of the hybrid arcade-style, wager-based game may facilitate a gameplay environment in which multiplayer functionality takes place. The multiplayer gameplay may have multiple "enrollment" aspects in which one, for example, particular player could be on location at a casino playing a hybrid arcade/wager-based game, while another (e.g., different) player could be at a different location, concurrently participating in the same hybrid arcade/wager-based game, but without participating in any wagering aspect/portions of hybrid arcade/wager-based game. A non-wagering game such as this is commonly known as a "free to play" game, which the player is allowed to download and install on their own devices. The player may then progress through the game (e.g., which is very similar to its the wager-based counter-part) without taking part in wager-based events. Gaming situations such as these may promote a "clicks to bricks" outcome where a casino property promotes their games to home users and invites them to develop familiarity and expertise on non-wagering versions of the games. Later, those same home players may be invited to visit the casinos to play the hybrid arcade/wager version of the games.

In some embodiments, different players concurrently participating in the same hybrid arcade/wager-based game may each separately configure his/her respective wagering parameters/amounts, which may be different from the wagering parameters/amounts configured by other game player-participants.

FIG. 1 illustrates a block diagram of an embodiment of a hybrid arcade/wager-based gaming system 100 which may be implemented via a computer network. At least a portion of the various functions, actions, operations, and activities performed by one or more component(s) of the hybrid arcade/wager-based gaming system may be initiated in response to detection of one or more conditions, events, and/or other criteria satisfying one or more different types of minimum threshold criteria. According to embodiments, at least a portion of the various types of functions, operations, actions, and/or other features provided by the hybrid arcade/wager-based gaming system may be implemented at one or more client systems(s), at one or more system server(s), and/or combinations thereof. According to different embodiments, the present hybrid arcade/wager-based gaming system 100 may be implemented in hardware and/or combinations of hardware and software.

According to one embodiment, a hybrid arcade/wager-based gaming system 100 may include local casino system(s) 122, client computer systems 130, mobile devices 160 and remote/Internet-based gaming services 190 and other 3rd party entities 150, coupled to a computer/communication network 110. The local casino system(s) 122 may include local casino gaming system server(s) 120. The local casino system(s) 122 may also include and class 2 RNG system(s)/service(s) 124. The Class 2 RNG system(s)/service(s) 124 may be configured to dynamically generate and/or provide Class 2 gaming type RNG outcomes to be used by hybrid arcade/wager-based Gaming devices as "predetermined" RNG outcome(s). Class 3 RNG system(s)/service(s) 126 may also be provided to dynamically generate and provide Class 3 gaming "predetermined" RNG outcome(s). Local casino system(s) 122 may also include electronic gaming machine(s) (EGMs) 128 that may be configured as described herein below.

Client computer system(s) 130 may also be operable to couple to the network 110 and implement various types of functions, operations, actions, and/or other features such as those described or referenced herein via, for example, a web browser 132. Similarly, mobile computing devices 160 (e.g., mobile phones, tablets and the like) may be configured to access the network 110 and to use a mobile web browser 162 and/or one or more mobile applications (apps) 166 to implement some or all of the functionality described herein. Third party entities 150 may also be configured to carry out some or all of the functionality described herein via the network 110.

Remote/Internet-based gaming service(s) 190 may also be coupled to network 110 and may comprise class 2 RNG system(s)/service(s) 194 as described relative to reference numeral 124, class 3 RNG system(s)/service(s) 196 as described relative to reference numeral 126, and remote database system(s) 180. Remote system(s)/service(s) 170 may be provided, which may include, for example, content provider servers/services, media streaming servers/services, database storage/access/query servers/services, financial transaction servers/services, payment gateway servers/services, electronic commerce servers/services, event management/scheduling servers/services and/or other services as needed. Remote/Internet-based gaming service(s) 190 may also include gaming servers 192.

According to embodiments, multiple instances or threads of hybrid arcade/wager-based gaming may be concurrently implemented and/or initiated via the use of one or more processors and/or other combinations of hardware and/or hardware and software. Embodiments may access and/or utilize information from one or more associated databases via communication with one or more local and/or remote memory devices.

According to different embodiments, various different types of encryption/decryption techniques may be used to facilitate secure communications over the network 110 and/or via other communication channels. For example, such encryption may utilize random number generators, SHA-1 (e.g., Secured Hashing Algorithm), MD2, MDS, DES (e.g., Digital Encryption Standard), 3DES (e.g., Triple DES), RC4 (e.g., Rivest Cipher), ARC4 (e.g., related to RC4), TKIP (e.g., Temporal Key Integrity Protocol, uses RC4), AES (e.g., Advanced Encryption Standard), RSA, DSA, DH, NTRU, and ECC (e.g., elliptic curve cryptography), PKA (e.g., Private Key Authentication), Device-Unique Secret Key and other cryptographic key data, SSL and/or others.

Other security features may include use of well-known hardware-based and/or software-based security components, and/or any other known or yet to be devised security and/or hardware and encryption/decryption processes implemented in hardware and/or software.

Embodiments of hybrid arcade/wager-based gaming described herein may be implemented in hardware and/or a combination of both hardware and software. Possible implementations include in an operating system kernel, in a separate user process, in a library package bound into network applications, on a specially constructed machine, or on a network interface card. In a specific embodiment, various aspects described herein may be implemented in software such as an operating system or in an application running on an operating system.

Alternatively, hardware and/or software embodiments of present hybrid arcade/wager-based gaming techniques described herein may be implemented on a general-purpose programmable computer selectively activated or reconfigured by a computer program stored in memory. Such programmable machine may include, for example, mobile or handheld computing systems, PDA, smart phones, notebook computers, tablets, netbooks, desktop computing systems, system servers, cloud computing systems, network devices, etc.

Figure 2:
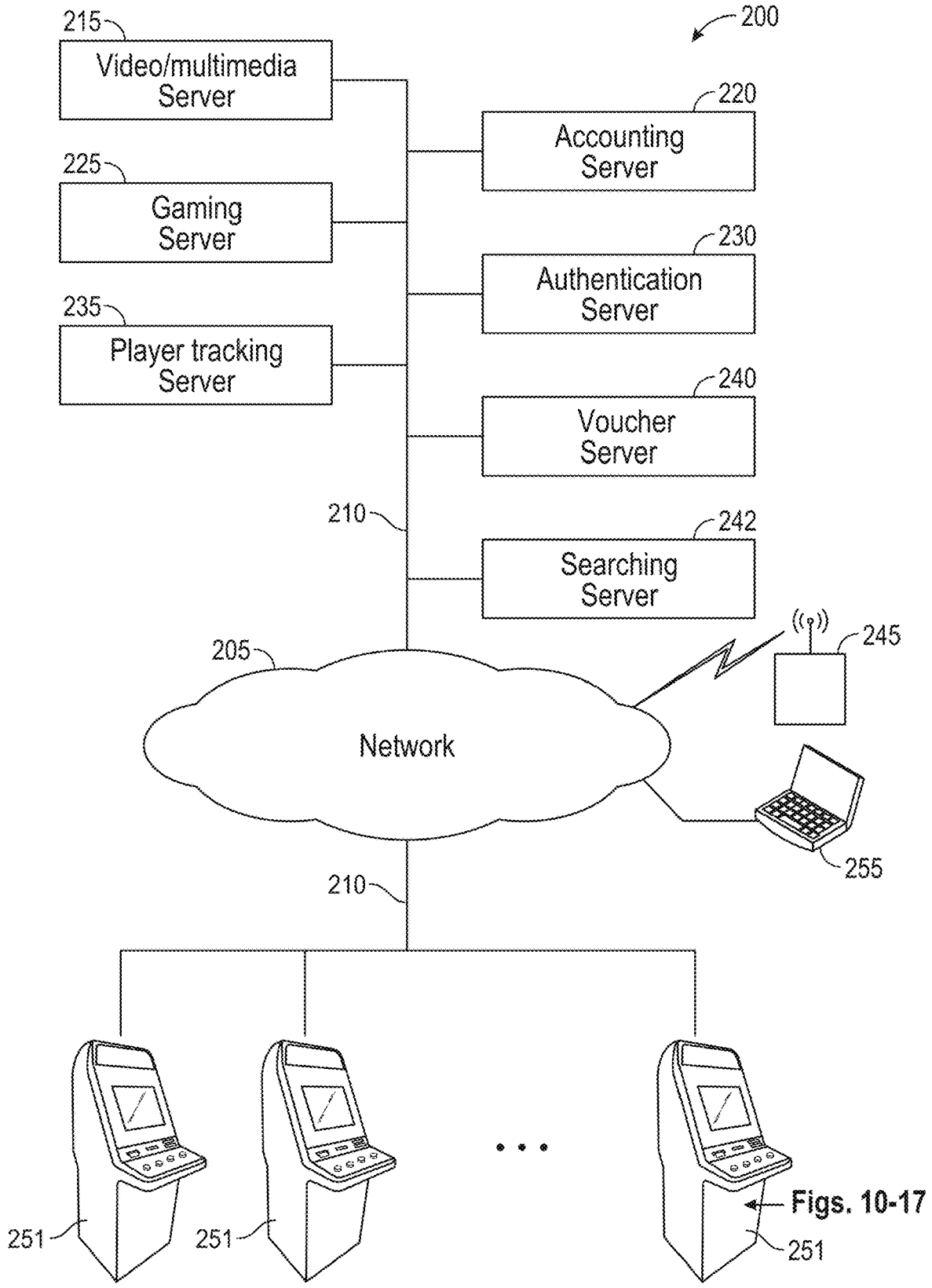
FIG. 2 shows a block diagram of an electronic gaming system according to one embodiment.

FIG. 2 shows an example block diagram of an electronic gaming system 200 according to one embodiment. As shown, electronic gaming system 200 may include electronic gaming devices (EGD) 251 (e.g., electronic gaming terminals, electronic gaming machines, wager-based video gaming machines, etc.), which may be coupled to network 205 via a network link 210. Network 205 may include the internet and/or a private network. One or more video streams may be received at video/multimedia server 215 from EGDs 251. Video/multimedia server 215 may also send one or more video streams to mobile devices 245, 255, EGDs 251, and/or other remote electronic devices. Video/multimedia server 215 may send these video streams via network link 210 and network 205.

Electronic gaming system 200 may include an accounting/transaction server 220, a gaming server 225, an authentication server 230, a player tracking server 235, a voucher server 240, and a searching server 242. The accounting/transaction server 220 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. Accounting/transaction server 220 may also generate tax information relating to these wagers, generate profit/loss and/or other reports for predetermined gaming options, contingent gaming options, predetermined betting structures, and/or outcome categories. Gaming server 225 may generate gaming options based on predetermined betting structures and/or outcome categories. These gaming options may be predetermined gaming options, contingent gaming options, and/or any other gaming option disclosed herein. The authentication server 230 may determine the validity of vouchers, players' identity, and/or an outcome for a gaming event. The player tracking server 235 may track a player's betting activity, a player's preferences such as the player's preferred language, drinks, font, sound level, and the like. Based on data obtained by player tracking server 235, a player may be eligible for gaming rewards (e.g., free play), promotions, and/or other awards (e.g., complimentary food, drinks, lodging, concerts, etc.). Voucher server 240 may generate a voucher, which may include data relating to gaming options. The generated vouchers may be physical (e.g., paper) or digital.

Searching server 242 may implement a search on one or more gaming devices to obtain gaming data. Searching server 242 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop-up window, a text message, an email, a voice message, a video message and the like. Searching server 242 may implement a wagering function, which may be an automatic wagering mechanism. These functions of searching server 242 may be integrated into one or more servers. Searching server 242 may be configured to, for example, determine which games paid out the most money during a time period, which games kept the most money from players during a time period, which games are most popular (e.g., top games), which games are least popular, which games have the most amount of money wager during a period, which games have the highest wager volume, which games are more volatile (e.g., volatility, or deviation from the statistical norms, of wager volume, wager amount, pay out, etc.) during a time period, and the like. Search may also be associated with location queries, time queries, and/or people queries.

According to embodiments, the gaming network 300 may include a display system server(s) 304 configured manage content (e.g., graphics, images, text, video fees, etc.) to be displayed and/or presented at one or more EGDs, dealer displays, administrator displays, etc. One or more EGD multimedia system server(s) 305 may be provided and coupled to network 310 and configured to manage content (e.g., graphics, images, text, video fees, audio feeds, etc.), which, for example, is to be streamed or provided to one or more EGDs (e.g., or to one or more groups of EGDs). One or more messaging system server(s) 306 may be provided and coupled to network 310 and configured for the management of messaging and/or other communications among and between the various systems, components, devices, EGDs, players, dealers, and administrators of the gaming network. mobile system server(s) 308 may manage communications and/or data exchanged with various types of mobile devices such as player-managed mobile devices (e.g., smart phones, PDAs, tablets, mobile computers), casino-managed mobile devices (e.g., mobile gaming devices). financial system server(s) 312 may be configured to track, manage, report and store financial data and financial transactions relating to one or more hybrid arcade/wager-based game sessions. According to one embodiment, a player tracking system server 314 may include at least one database that tracks each player's hands, wins/losses, bet amounts, player preferences, etc., in the network. In one implementation, the presenting and/or awarding of promotions, bonuses, rewards, achievements, etc., may be based on a player's play patterns, time, games selected, bet amount for each game type, etc. A player tracking system server may also help establish a player's preferences, which assists the casino in their promotional efforts to: award player comps (e.g., loyalty points); decide which promotion(s) are appropriate; generate bonuses and the like. Data tracking & analysis system(s) 318 may be configured to manage and analyze game data. In one embodiment, the data tracking & analysis system(s) may be configured to aggregate multisite hybrid arcade/wager-based gaming trends, local wins and jackpots.

Gaming system server(s) 322, 324 may each be dedicated to one or more specifically designated type(s) of game(s). Each game server may include game logic to host one of more virtual hybrid arcade/wager-based game sessions. At least some game server(s) may also be configured to track of the game accounting (e.g., money in, money out) for a virtual hybrid arcade/wager-based game being played, and/or for updating the financial system servers 312 at the end of each game. The game server(s) 322, 324 may also configured to generate the EGD graphics primitives (e.g., game virtual objects and game states), and may further be operable to update EGDs when a game state change (e.g., new card dealt, player upped the ante, player folds/busts, etc.) is detected. Jurisdictional/regulatory monitoring & enforcement system(s) 350 may be configured to handle tracking, monitoring, reporting, and enforcement of specific regulatory requirements relating to wager-based gameplay activities in one or more jurisdictions.

Authentication & validation system(s) 352 may be configured to determine and/or authenticate the identity of the current player at a given EGD. For example, in one embodiment, the current player may be required to perform a log in process at the EGD in order to access one or more features. Alternatively, the EGD may be adapted to automatically determine the identity of the current player based upon one or more external signals such as, for example, scanning of a barcode of a player tracking card, an RFID tag or badge worn by the current player which provides a wireless signal to the EGD for determining the identity of the current player. In at least one implementation, various security features may be incorporated into the EGD to prevent unauthorized players from engaging in certain types of activities at the EGD. In some embodiments, the authentication & validation system(s) 352 may be configured to authenticate and/or validate various types of hardware and/or software components, such as, for example, hardware/software components residing at a remote EGDs, game play information, wager information, player information and/or identity, etc.

Figure 3:
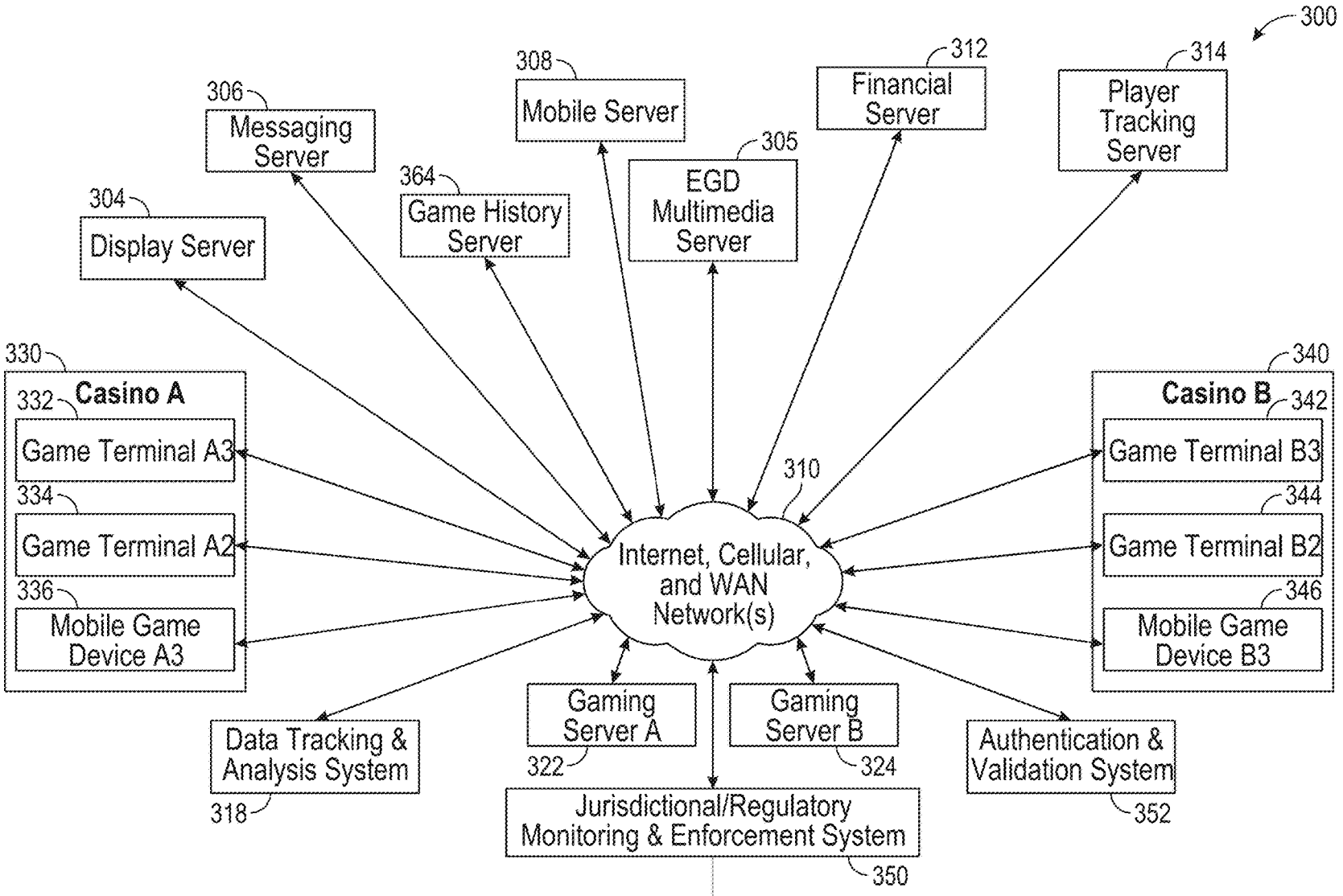
FIG. 3 illustrates a network diagram of gaming network that may be configured to implement embodiments described herein.

Casino venues, shown in FIG. 3 as Casino A 330 and Casino B 340, may correspond to a real-world, physical casino located at a particular geographic location. In some embodiments, a portion of the multiple different casino venues may be affiliated with one another (e.g., Harrah's Las Vegas, Harrah's London). In other embodiments, at least a portion of the multiple different casino venues do not share any affiliation with each other.

EGDs 332, 334, 336, 342, 344, 346 may be configured to enable players to participate in game sessions according to embodiments. Different EGDs may be physically located in one or more different casino venues, and may be connected via a communication network such as shown at 310 in FIG. 3, which may include Internet, Cellular, and WAN Network (s). In some embodiments, EGDs may be implemented as stationary machines. In some embodiments, at least some EGDs may be implemented using mobile devices (e.g., tablets, smartphones, laptops, PC's, and the like).

Game history server(s) 364 may be provided. Game history servers 364 may be configured to track game types and game play history for hybrid arcade/wager-based games. In some embodiments, a game history server may also assist the casino manager in case of disputes between players and the casino by, for example, providing the ability to "replay" (e.g., by virtually recreating the game events) the game in dispute, step by step, based on previously stored game states. Remote database system(s) may be coupled to network 310 and selectively accessible and may be configured to store and provide access to various types of information and data described herein. Remote system server(s)/service(s) may be provided, and configured to provide, for example, content provider servers/services media streaming servers/services database storage/access/query servers/services, financial transaction servers/services, payment gateway servers/services, electronic commerce servers/services, event management/scheduling servers/services and/or other services. Mobile Game Device(s) 336, 346 may be configured to provide the services described below relative to FIG. 6.

According to specific embodiments, a variety of different game states may be used to characterize the state of current and/or past events which are occurring (e.g., or have occurred) at a given EGD. For example, in one embodiment, at any given time in a game, a valid current game state may be used to characterize the state of game play (e.g., and/or other related events, such as, for example, mode of operation of the EGD, etc.) at that particular time. In at least one embodiment, multiple different states may be used to characterize different states or events which occur at the EGD at any given time. In one embodiment, when faced with ambiguity of game state, a single state embodiment forces a decision such that one valid current game state is chosen. In a multiple state embodiment, multiple possible game states may exist simultaneously at any given time in a game, and at the end of the game or at any point in the middle of the game, the EGD may analyze the different game states and select one of them based on certain criteria. Thus, for example, when faced with ambiguity of game state, the multiple state embodiment(s) allow all potential game states to exist and move forward, thus deferring the decision of choosing one game state to a later point in the game. The multiple game state embodiment(s) may also be more effective in handling ambiguous data or game state scenarios.

A variety of different entities may be used (e.g., either singly or in combination) to track the progress of game states which occur at a given gaming EGD. Examples of such entities may include a master controller system, display system, gaming system, local game tracking component(s), remote game tracking component(s), etc. Examples of various game tracking components may include, but are not limited to: automated sensors, manually operated sensors, video cameras, intelligent playing card shoes, RFID readers/writers, RFID tagged chips, objects displaying machine readable code/patterns, etc.

Local game tracking components at the EGD may be operable to automatically monitor game play activities at the EGD, and/or to automatically identify key events which may trigger a transition of game state from one state to another as a game progresses. Depending upon the type of game being played at the gaming table, examples of possible key events may include the start of a new gaming session; the end of a current gaming session; the start of a virtual slot wheel spin; a game start event; a game end event; the detection of an event that triggers the initiation of wager-based event (e.g., killing a zombie, carrying out a predetermined action upon encountering a wagering opportunity, and the like); the detection of event that triggers the end of a wager-based event; the detection of event that triggers the initiation or end of a randomized game play event; an initial wager period start or end; a subsequent wager period start or end; or a payout period start or end.

Figure 4:
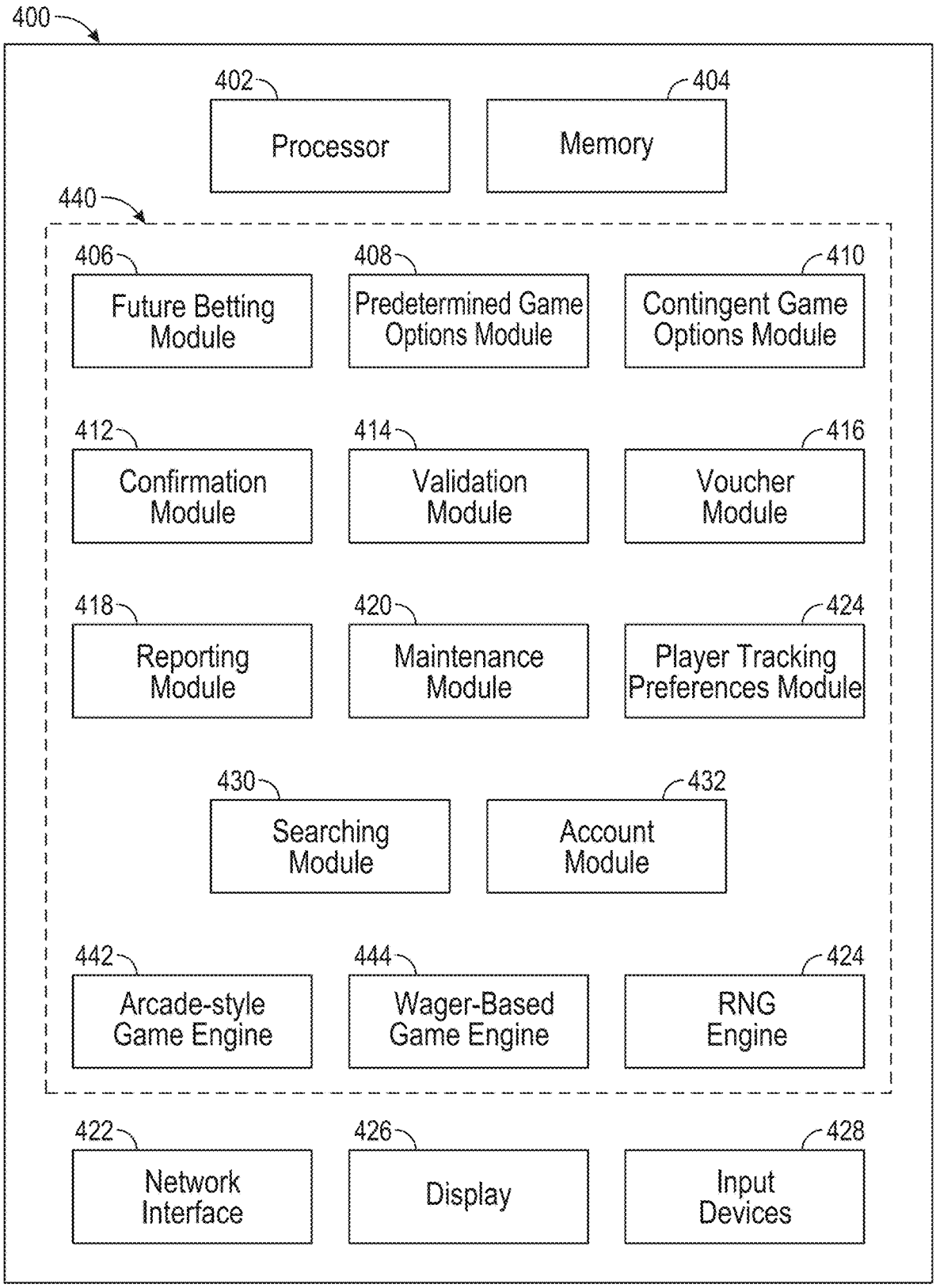
FIG. 4 is a block diagram of electronic gaming device, according to an embodiment.

FIG. 4 shows a block diagram 400 of electronic gaming device 400 according to one embodiment. As shown, electronic gaming device 400 may include a processor 402, a memory 404, a network interface 422, input devices 428, and a display 426. Processor 402 may generate gaming options based on predetermined betting structures and/or outcome categories. Predetermined betting structures may utilize more than one outcome category to generate via processor 402 gaming options. Predetermined betting structures may combine any outcome category with any other outcome category to gaming options. The processor 402 may offer a gaming option that is structured so that the gaming option relates to more than one EGD. Processor 402 may generate contingent gaming options and/or predetermined gaming options. Contingent gaming options 410 may be structures configured such that a wager is activated when a triggering event occurs.

Network interface 422 may be configured to enable the electronic gaming device 400 to communicate with remote devices/systems such as, for example, video/multimedia server(s), accounting/transaction server(s), gaming server(s), authentication server(s), player tracking server(s), voucher server(s) over a communication network, such as shown at 110, 205 and 310. Input devices 428 may be or include mechanical buttons, electronic buttons, one or more touchscreens, microphones, cameras, optical scanners, or any combination thereof. Input devices 428 may be utilized to make a wager, to make an offer to buy or sell a voucher, to determine a voucher's worth, to cash in a voucher, to modify (e.g., change sound level, configuration, font, language, etc.) electronic gaming device 400, to select a movie or music, to select type of content to be displayed on main and/or auxiliary screen(s) of EGD, or any combination thereof.

Arcade-style game engine 442 may be configured to manage the arcade-style game play portion (or entertainment portion) of the hybrid arcade/wager-based game. In contrast, a wager-based game engine 444 may be configured to manage the wager-based game event portion(s) of games according to embodiments. A Random Number Generator (RNG) Engine 446 may be provided and may include software and/or hardware algorithm and/or processes which are used to generate random outcomes and may be used by the wager-based game engine to generate wager-based game event outcomes.

Display 426 may show video streams from one or more gaming devices, gaming objects from one or more gaming devices, computer generated graphics, predetermined gaming options, and/or contingent gaming options. The memory 404 may include various memory modules 440, including a future betting module 406, a predetermined game options module 408, a contingent game options module 410, a confirmation module 412, a validation module 414, a voucher module 416, a reporting module 418, a maintenance module 420, a player tracking preferences module 424, a searching module 430, and an account module 432.

Future betting module 406 may store data relating to the predetermined betting structure. Processor 402 may utilize data in future betting module 406 to generate predetermined gaming options and/or contingent gaming options. Any other processor (e.g., gaming server 225, any virtualized gaming server, etc.) may implement the functions of processor 402. Predetermined game options module 408 may store data relating to predetermined gaming options, which may be offered to a player. The contingent game options module 410 may store data relating to contingent gaming options, which may be offered to a player. The confirmation module 412 may utilize data received from a voucher, the transaction history of the voucher (e.g., in the case in which the voucher changed hands in a secondary market), and/or the identity of the player to confirm the value of the voucher. In another example, confirmation module 412 may utilize game event data, along with voucher data to confirm the value of the voucher. A validation module 414 may utilize data received from a voucher to confirm the validity of the voucher. Voucher module 416 may store data relating to generated vouchers, redeemed vouchers, bought vouchers, and/or sold vouchers. Reporting module 418 may generate reports related to a performance of electronic gaming device 400, electronic gaming system(s), hybrid arcade/wager-based game(s), video streams, gaming objects, credit device(s) or identification device(s), for example.

In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top tables with the most payouts, top search structures used by players, most popular hybrid arcade/wager-based game(s) by wager volume, most searched for game, hybrid arcade/wager-based game(s) with least payouts, weekly trends, monthly trends, and other statistics related to game plays, wagers, people, location, and searches.

Maintenance module 420 may track any maintenance that is implemented on electronic gaming device 400 and/or electronic gaming system 200. Maintenance module 420 may schedule preventative maintenance and/or request a service call based on a device error. The player tracking preferences module 424 may compile and track data associated with a player's preferences.

Searching module 430 may include one or more searching structures, one or more searching algorithms, and/or any other searching mechanisms. In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In another example, the searching structures may be based on one or more specific games. In another example, the searching structure may be based on a player's preferences, past transactional history, player input, a hybrid arcade/wager-based game or game type, a particular EGD, a particular casino, a particular location within a casino, game outcomes over a time period, payout over a time period, and/or any other criteria. Searching algorithms may be dynamic searching programs, which may be modified based on one or more past results, as described previously. In another example, the search algorithm may generate a search priority based on the probability of success various events and/or conditions. In some embodiments, the search algorithm may utilize any dynamic feedback procedure to enhance current and/or future searching results.

Account module 432 may include data relating to an account balance, a wager limit, a number of wagers placed, credit limits, any other player information, and/or any other account information. Data from account module 432 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

In at least one embodiment, at least a portion of the modules discussed in block diagram 400 may reside locally in gaming terminal 400. However, in at least some embodiments, at least part of the functions performed by these modules may be implemented in one or more remote servers. For instance, modules 406-420 and 424 may each be on a remote server, communicating with gaming terminal 400 via a network interface such as Ethernet in a local area network (LAN) or a wide area network (WAN) topology. In some implementations, these servers may be physical servers in a data center. In some other implementations, these servers may be virtualized. In yet some other implementations, the functions performed by these modules may be implemented as web services. For example, the predetermined game options module 408 may be implemented in software as a web service provider. Gaming terminal 400 would make service requests over the web for the available predetermined wager options to be displayed. Regardless of how the modules and their respective functions are implemented, the interoperability with the gaming terminal 400 is seamless. In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top EGDs with the most payouts, top search structures used by players, most popular hybrid arcade/wager-based game(s) by wager volume, most searched for game(s), EGDs with least payouts, weekly trends, monthly trends, and other statistics related to game plays, wagers, people, location, and searches.

Figure 5:
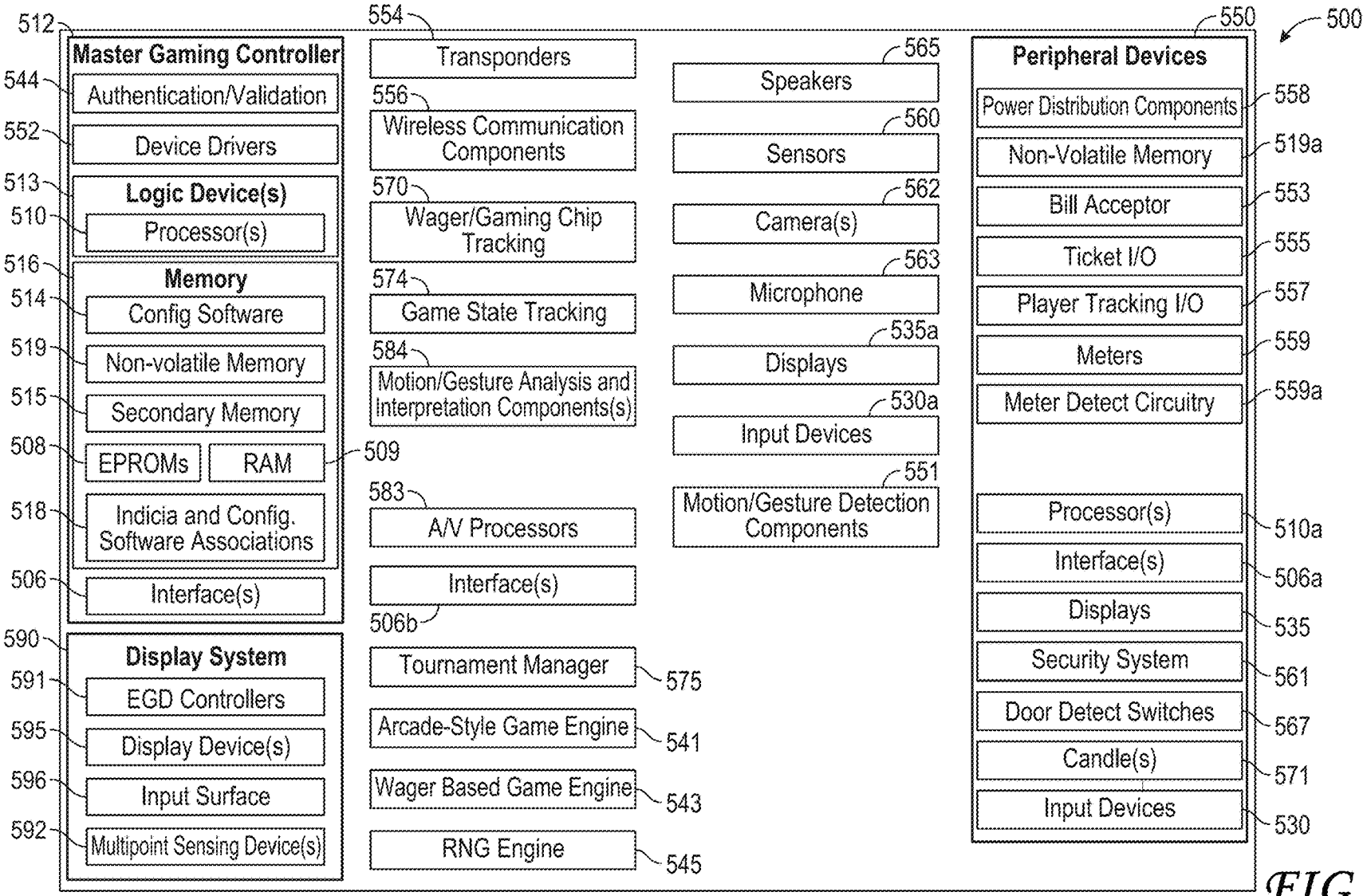
FIG. 5 is a block diagram of an intelligent electronic gaming system, according to one embodiment.

FIG. 5 is a block diagram of an exemplary intelligent multi-player electronic gaming system 500 according to one embodiment. Gaming system 500 may be implemented as a gaming server or as an electronic gaming machine (e.g., EGM) or electronic gaming device (e.g., EGD).

As shown, gaming system 500 may include at least one processor 510, at least one interface 506, and memory 516. Additionally, gaming system 500 may include at least one master gaming controller 512, a multi-touch sensor and display system 590, a plurality of peripheral device components 550, and various other components, devices, systems such as, for example, arcade-style game engine(s) 541; wager-based game engine(s) 543; RNG engine(s) 545; transponders 554; wireless communication components 556; gaming chip/wager token tracking components 570; games state tracking components 574; motion/gesture analysis and interpretation components 584, and audio/video processors 583 which, for example, may include functionality for detecting, analyzing and/or managing various types of audio and/or video information relating to various activities at the gaming system. Various interfaces **506*b* may be provided for communicating with other devices, components and systems, as may be tournament manager 575; sensors 560; one or more cameras 562; one or more microphones 563; secondary display(s) 535*a*; input devices 530*a*; motion/gesture detection components 551; and peripheral devices 550**.

The arcade-style game engine(s) 541 may be configured to manage the arcade-style game play portion (or entertainment portion) of the hybrid arcade/wager-based game. Conversely, the wager-based game engine(s) 543 may be configured to manage the wager-based game event portion(s) of the hybrid arcade/wager-based game. RNG engine(s) 545 may include software and/or hardware algorithm and/or processes used to generate random outcomes, and may be used by the wager-based game engine to generate wager-based game event outcomes. Monetary payout manager 522 may be configured or designed to include functionality for determining the appropriate monetary payout(s) (if any) to be distributed to player(s) based on the outcomes of the wager-based game events which are initiated during play of one or more hybrid arcade/wager-based games. The non-monetary payout manager 524 may be configured to include functionality for determining the appropriate non-monetary payout(s) (if any) to be awarded or distributed to player(s) based on the outcomes of the wager-based game events which are initiated during play of one or more hybrid arcade/wager-based games.

One or more cameras (e.g., 562) may be used to monitor, stream and/or record image content and/or video content relating to persons or objects within each camera's view. For example, in at least one embodiment where the gaming system is implemented as an EGD, camera 562 may be used to generate a live, real-time video feed of a player (e.g., or other person) who is currently interacting with the EGD. In some embodiments, camera 562 may be used to verify a user's identity (e.g., by authenticating detected facial features), and/or may be used to monitor or tract facial expressions and/or eye movements of a user or player who is interacting with the gaming system.

In at least one embodiment, display system 590 may include EGD controllers 591; multipoint sensing device(s) 592 (e.g., multi-touch surface sensors/components); display device(s) 595; and Input/touch surface 596. According to embodiments, display surface(s) 595 may include one or more display screens. Master gaming controller 512 may include authentication/validation components 544; device drivers 552; logic devices 513, which may include one or more processors 510; memory 516, which may include configuration software 514, non-volatile memory 519, EPROMS 508, RAM 509, associations 518 between indicia and configuration software, and interfaces 506.

In at least one embodiment, the peripheral devices 550 may include power distribution components 558; non-volatile memory **519*a* (e.g., and/or other types of memory); bill acceptor 553; ticket I/O 555; player tracking I/O 557; meters 559 (e.g., hard and/or soft meters); meter detect circuitry 559*a*; processor(s) 510*a*; interface(s) 506*a*; display(s) 535; independent security system 561; door detect switches 567; candles, etc. 571; input devices 530**, for example.

In one implementation, processor 510 and master gaming controller 512 may be included in a logic device 513 enclosed in a logic device housing. The processor 510 may include any conventional processor or logic device configured to execute software (i.e., sequences of computer-readable instructions to be executed) allowing various tasks such as communicating with a remote source via communication interface 506, such as a server that stores authentication information or games; converting signals read by an interface to a format corresponding to that used by software or memory in the gaming system; accessing memory to configure or reconfigure game parameters in the memory according to indicia read from the device; communicating with interfaces, various peripheral devices and/or I/O devices; operating peripheral devices such as, for example, card readers, paper ticket readers, etc.; operating various I/O devices such as, for example, displays 535 and input devices 530. For instance, the processor 510 may send messages including game play information to the displays 535 to inform players of game play/event information, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic and/or chip-card card readers commercially available for reading a player-specific identification information. The player-specific information can be provided on specially constructed magnetic cards issued by a casino, or magnetically coded credit cards or debit cards frequently used with national credit organizations such as Visa, MasterCard, American Express, or banks and other institutions.

The gaming system may include other types of participant identification mechanisms which may use a fingerprint image, eye blood vessel image reader, or other suitable biometric information to confirm identity of the player. Such personalized identification information could also be used to confirm credit use of a smart card, transponder, and/or player's personal player input device (e.g., UID).

The gaming system 500 also includes memory 516 which may include, for example, volatile memory (e.g., RAM 509), non-volatile memory 519 (e.g., disk memory, FLASH memory, EPROMs, etc.), unalterable memory (e.g., EPROMs 508), etc. The memory may be configured or designed to store, for example: 1) configuration software 514 such as all the parameters and settings for a game playable on the gaming system; 2) associations 518 between configuration indicia read from a device with one or more parameters and settings; 3) communication protocols allowing the processor 510 to communicate with peripheral devices and I/O devices 4) a secondary memory storage device 515 such as a non-volatile memory device, configured to store gaming software related information (e.g., the gaming software related information and memory may be used to store various audio files and games not currently being used and invoked in a configuration or reconfiguration); 5) communication transport protocols (e.g., such as, for example, TCP/IP, USB, Firewire, lEEE1394, Bluetooth, IEEE 802.11x (e.g., IEEE 802.11 standards), hiperlan/2, HomeRF, etc.) for allowing the gaming system to communicate with local and non-local devices using such protocols; etc. In one implementation, the master gaming controller 512 communicates using a serial communication protocol. A few examples of serial communication protocols that may be used to communicate with the master gaming controller include but are not limited to USB, RS-232 and Netplex (e.g., a proprietary protocol developed by IGT, Reno, Nev.).

A plurality of device drivers 552 may be stored in memory 516. Example of different types of device drivers may include device drivers for gaming system components, device drivers for gaming system components, etc. The device drivers 552 may utilize a communication protocol of some type that enables communication with a particular physical device. The device driver abstracts the hardware implementation of a device. For example, a device driver may be written for each type of card reader that may be potentially connected to the gaming system. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (e.g., Wi-Fi), etc. When one type of a particular device is exchanged for another type of the particular device, a new device driver may be loaded from the memory 516 by the processor 510 to allow communication with the device. For instance, one type of card reader in gaming system 500 may be replaced with a second type of card reader where device drivers for both card readers are stored in the memory 516.

The software units stored in the memory 516 may be upgraded as needed. For instance, when the memory 516 is a hard drive, new games, game options, various new parameters, new settings for existing parameters, new settings for new parameters, device drivers, and new communication protocols may be uploaded to the memory from the master gaming controller 512 or from some other external device. As another example, when the memory 516 includes a CD/DVD drive including a CD/DVD designed or configured to store game options, parameters, and settings, the software stored in the memory may be upgraded by replacing a second CD/DVD with a second CD/DVD. In yet another example, when the memory 516 uses one or more flash memory 519 or EPROM 508 units designed or configured to store games, game options, parameters, settings, the software stored in the flash and/or EPROM memory units may be upgraded by replacing one or more memory units with new memory units which include the upgraded software. One or more of the memory devices, such as the hard-drive, may be employed in a game software download process from a remote software server.

The gaming system 500 may also include various authentication and/or validation components 544 which may be used for authenticating/validating specified gaming system components such as, for example, hardware components, software components, firmware components, information stored in the gaming system memory 516, etc.

Sensors 560 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone and/or detecting (e.g., in real time) the presence and/or monetary amount of gaming chips which are within the player's personal space, for example. In one implementation, at least a portion of the sensors 560 and/or input devices 530 may be implemented in the form of touch keys selected from a wide variety of commercially available touch keys used to provide electrical control signals. Alternatively, some of the touch keys may be implemented by a touch-screen display. For example, in at least one implementation, the gaming system player may include input functionality for enabling players to provide their game play decisions/instructions (e.g., and/or other input) to the EGD using the touch keys and/or other player control sensors/buttons. Additionally, such input functionality may also be used for allowing players to provide input to other devices in the casino gaming network (e.g., such as, for example, player tracking systems, side wagering systems, etc.)

Wireless communication components 556 may include one or more communication interfaces having different architectures and utilizing a variety of protocols such as, for example, 802.11 (e.g., Wi-Fi), 802.15 (e.g., including Bluetooth™), 802.16 (e.g., WiMAX), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information. An example of a near-field communication protocol is the ECMA-340 "Near Field Communication—Interface and Protocol (e.g., NFCIP-1)", published by ECMA International (e.g., www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 558 may include, for example, components or devices which are operable for providing wireless power to other devices. For example, in one implementation, the power distribution components 558 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

A motion/gesture detection component(s) 551 may be configured or designed to detect player movements and/or gestures and/or other input data from the player. In some implementations, each gaming system may have its own respective motion/gesture detection component(s). In other embodiments, motion/gesture detection component(s) 551 may be implemented as a separate sub-system of the gaming system which is not associated with any one specific gaming system or device.

Figure 6:
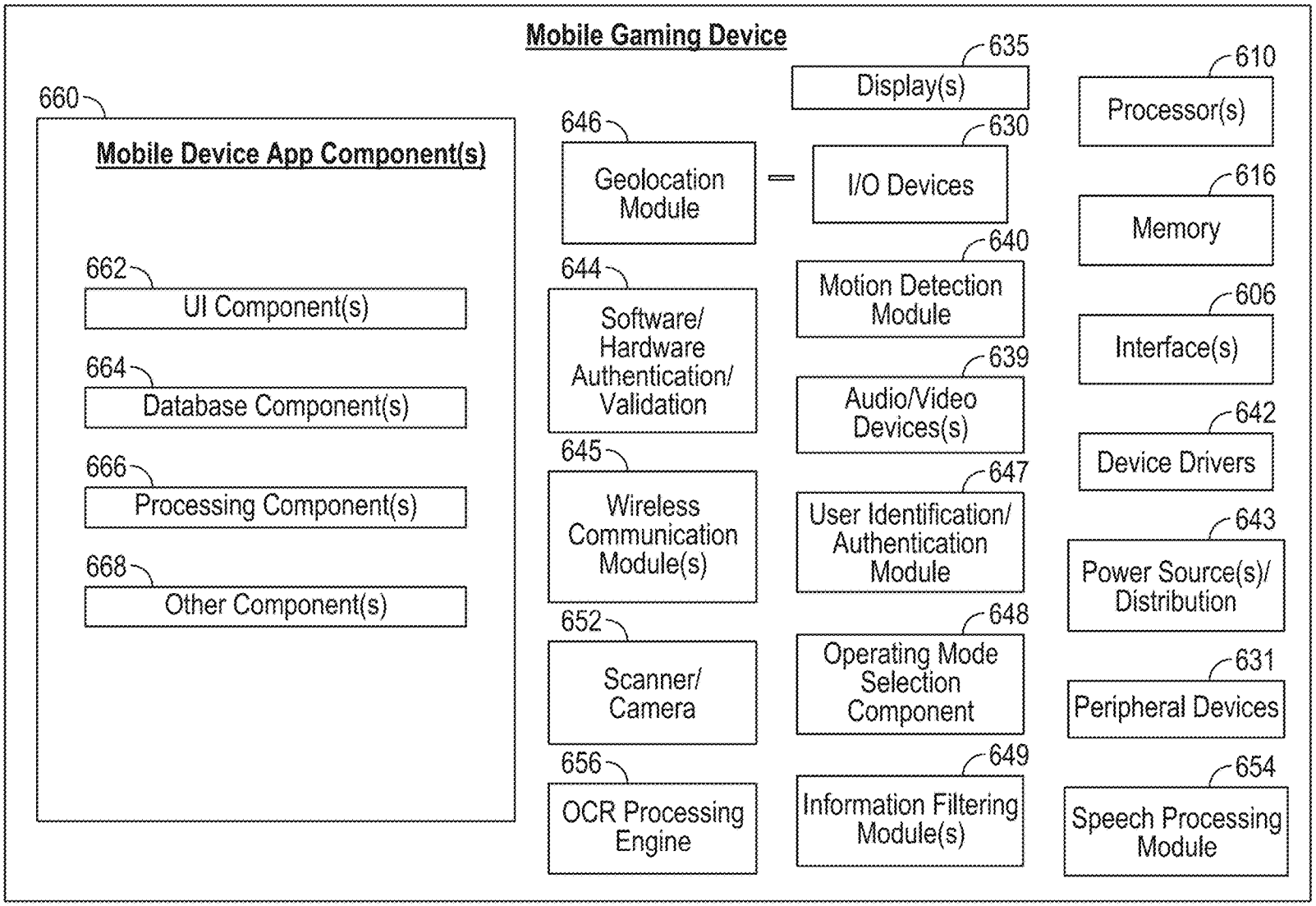
FIG. 6 is a block diagram of a mobile gaming device with which an embodiment may be practiced.

FIG. 6 is a block diagram of an exemplary mobile gaming device 600 in accordance with a specific embodiment. In at least one embodiment, one or more players may participate in a game session using mobile gaming devices. In at least some embodiments, the mobile gaming device may be configured or designed to include or provide functionality which is similar to that of an electronic gaming device (e.g., EGD) such as that described, for example, in FIG. 4.

As shown in FIG. 6, mobile gaming device 600 may include mobile device application components (e.g., 660), which, for example, may include UI components 662; database components 664; processing components 666 and/or other components 668 which, for example, may include components for facilitating and/or enabling the mobile gaming device to carry out the functionality described herein.

The mobile gaming device 600 may include mobile device app component(s) that have been configured or designed to provide functionality for enabling or implementing at least a portion of the functionality of the hybrid arcade/wager-based game techniques at the mobile gaming device.

According to embodiments, various aspects, features, and/or functionalities of the mobile gaming device may be performed, implemented and/or initiated by processor(s) 610; device drivers 642; memory 616; interface(s) 606; power source(s)/distribution 643; geolocation module 646; display(s) 635; I/O devices 630; audio/video devices(s) 639; peripheral devices 631; motion detection module 640; user identification/authentication module 647; client app component(s) 660; other component(s) 668; UI Component(s) 662; database component(s) 664; processing component(s) 666; software/hardware authentication/validation 644; wireless communication module(s) 645; information filtering module(s) 649; operating mode selection component 648; speech processing module 654; scanner/camera 652 and/or OCR processing engine 656, for example.

Figure 7:
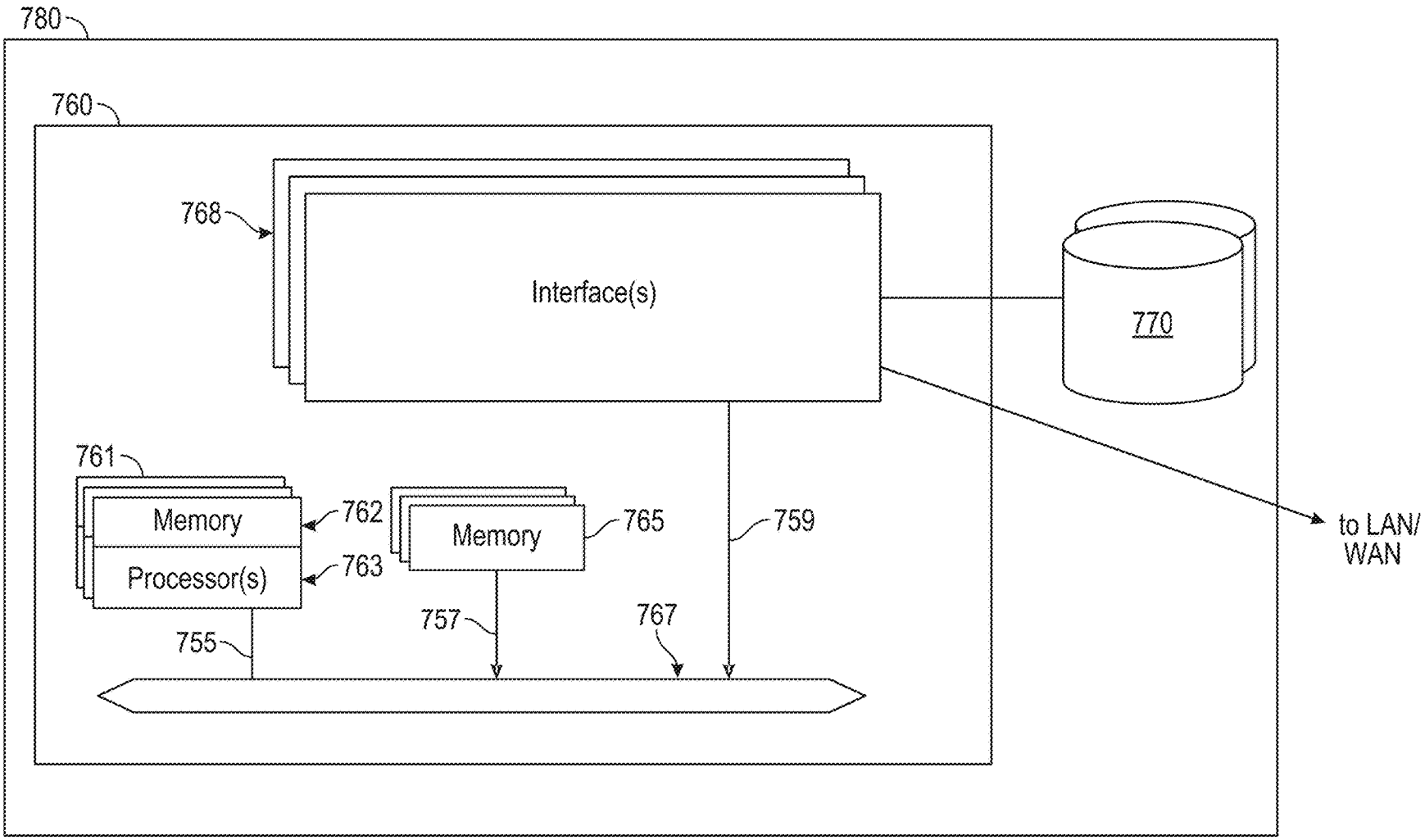
FIG. 7 shows a system server suitable for implementing various aspects of embodiments described herein.

FIG. 7 shows a system server 780 that may be configured according to embodiments. The system server 780 may include at least one network device 760, and at least one storage device 770 (e.g., such as, for example, a direct attached storage device). In one embodiment, system server 780 may be configured to implement at least some of the hybrid arcade/wager-based game techniques described herein. Network device 760 may include a master central processing unit (e.g., CPU) 762, interfaces 768, and a bus 767 (e.g., a PCI bus). When acting under the control of appropriate software or firmware, the CPU 762 may be responsible for implementing specific functions associated with the functions of a desired network device. For example, when configured as a server, the CPU 762 may be responsible for analyzing packets; encapsulating packets; forwarding packets to appropriate network devices; instantiating various types of virtual machines, virtual interfaces, virtual storage volumes, virtual appliances; etc. The CPU 762 preferably accomplishes at least a portion of these functions under the control of software including an operating system (e.g., Linux), and any appropriate system software (e.g., such as, for example, AppLogic (e.g., TM) software).

CPU 762 may include one or more processors 763 such as, for example, one or more processors from the AMD, Motorola, Intel and/or MIPS families of microprocessors. In an alternative embodiment, processor 763 may be specially designed hardware for controlling the operations of system server 780. In a specific embodiment, a memory 761 (e.g., such as non-volatile RAM and/or ROM) also forms part of CPU 762. However, there are different ways in which memory could be coupled to the system. Memory block 761 may be used for a variety of purposes such as, for example, caching and/or storing data, programming instructions, etc.

Interfaces 768 may be typically provided as interface cards. Alternatively, one or more of the interfaces 768 may be provided as on-board interface controllers built into the system motherboard. Generally, they control the sending and receiving of data packets over the network and sometimes support other peripherals used with the system server 780. Among the interfaces that may be provided may be FC interfaces, Ethernet interfaces, frame relay interfaces, cable interfaces, DSL interfaces, token ring interfaces, InfiniBand interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (e.g., Wi-Fi) interfaces, 802.15 interfaces (e.g., including Bluetooth™) 802.16 (e.g., WiMAX) interfaces, 802.22 interfaces, Cellular standards such as CDMA interfaces, CDMA2000 interfaces, WCDMA interfaces, TDMA interfaces, Cellular 3G interfaces, and the like.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 762 to efficiently perform routing computations, network diagnostics or security functions.

In at least one embodiment, some interfaces may be configured or designed to allow the system server 780 to communicate with other network devices associated with various local area network (e.g., LANs) and/or wide area networks (e.g., WANs). Other interfaces may be configured or designed to allow network device 760 to communicate with one or more direct attached storage device(s) 770.

Regardless of network device's configuration, it may employ one or more memories or memory modules (e.g., such as, for example, memory block 765, which, for example, may include random access memory (e.g., RAM)) configured to store data, program instructions, logic and processes for the general-purpose network operations and/or other information relating to the functionality of the embodiments described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (e.g., ROM) and random-access memory (e.g., RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 8:
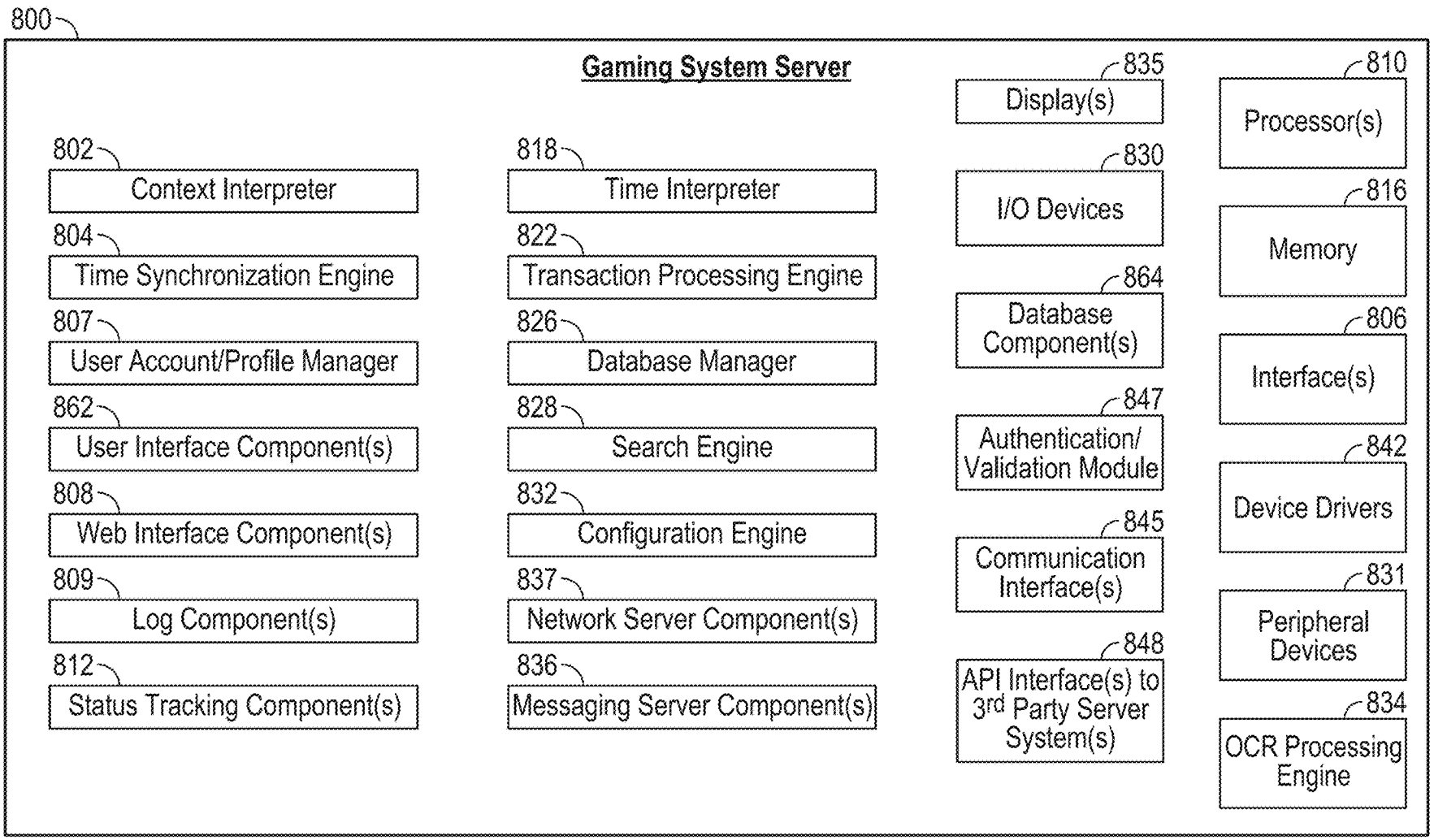
FIG. 8 shows a functional block diagram of a gaming system server according to one embodiment.

FIG. 8 illustrates an example of a functional block diagram of a gaming system server in accordance with a specific embodiment. As shown, the gaming system server 800 may a context interpreter 802 which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). Examples of contextual criteria which may be analyzed may include, but are not limited to, for example, location-based criteria (e.g., geolocation of mobile gaming device, geolocation of EGD, time-based criteria, identity of user(s), user profile information, transaction history information and recent user activities, for example. Time synchronization engine 804 may be operable to manage universal time synchronization (e.g., via NTP and/or GPS). The search engine 828 may be operable to search for transactions, logs, game history information, player information, hybrid arcade/wager-based game information, etc., which may be accessed from one or more local and/or remote databases. The gaming system server 800 may also include a configuration engine 832 that may be configured to determine and handle configuration of various customized configuration parameters for one or more devices, component(s), system(s), and process(es). Time interpreter 818 may be operable to automatically and/or dynamically modify or change identifier activation and expiration time(s) based on various criteria such as, for example, time, location, transaction status, etc. Authentication/validation component(s) 847 (e.g., password, software/hardware info, SSL certificates) may be operable to perform various types of authentication/validation tasks. The transaction processing engine 822 may be operable to handle various types of transaction processing tasks such as, described and/or referenced herein. An OCR processing engine 834 may be operable to perform image processing and optical character recognition of images such as those captured by a gaming device camera, for example. The database manager 826 may be configured to handle various types of tasks relating to database updates, management and access. In at least one embodiment, the database manager may be operable to manage game history databases, player tracking databases and/or other historical record keeping. Log component(s) 809 may be operable to generate and manage transactions history logs, system errors, connections from APIs. Status tracking component(s) 812 may be provided and configured to automatically and/or dynamically determine, assign, and/or report updated transaction status information based, for example, on a state of the transaction. Gateway component (s) may be operable to facilitate and manage communications and transactions with external payment gateways. Web interface component(s) 808 may be operable to facilitate and manage communications and transactions with virtual live electronic gaming device web portal(s). API interface(s) to gaming system server(s) may be operable to facilitate and manage communications and transactions with API Interface(s) to the gaming system server(s). API Interface(s) to 3rd party system server(s) may be provided, which may be operable to facilitate and manage communications and transactions with API interface(s) to 3rd party system server(s).

One or more general-purpose processors 810 may be provided. In an alternative embodiment, at least one processor may be specially designed hardware for controlling the operations of a gaming system. In a specific embodiment, a memory (e.g., such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software. Memory 816 may be provided. The memory 816 may include volatile memory (e.g., RAM), non-volatile memory (e.g., disk memory, FLASH memory, EPROMs, etc.), unalterable memory, and/or other types of memory. According to different embodiments, one or more memories or memory modules (e.g., memory blocks) may be configured or designed to store data, program instructions for the functional operations of the mobile gaming system and/or other information. The program instructions may control the operation of an operating system and/or one or more applications, for example. The memory or memories may also be configured to store data structures, metadata, identifier information/images, and/or information/data relating to other features/functions described herein. Interface(s) 806 may be provided such as, for example, wired interfaces and/or wireless interfaces. Suitable device driver(s) 842 may also be provided, as may be one or more display(s) 835. Messaging server component(s) 836, may provide various functions and operations relating to messaging activities and communications. Similarly, network server component(s) 837 may be configured to provide various functions and operations relating to network server activities and communications. User account/profile manager component(s) 807 may be provided to manage various aspects of user accounts and/or profiles.

Figure 9:
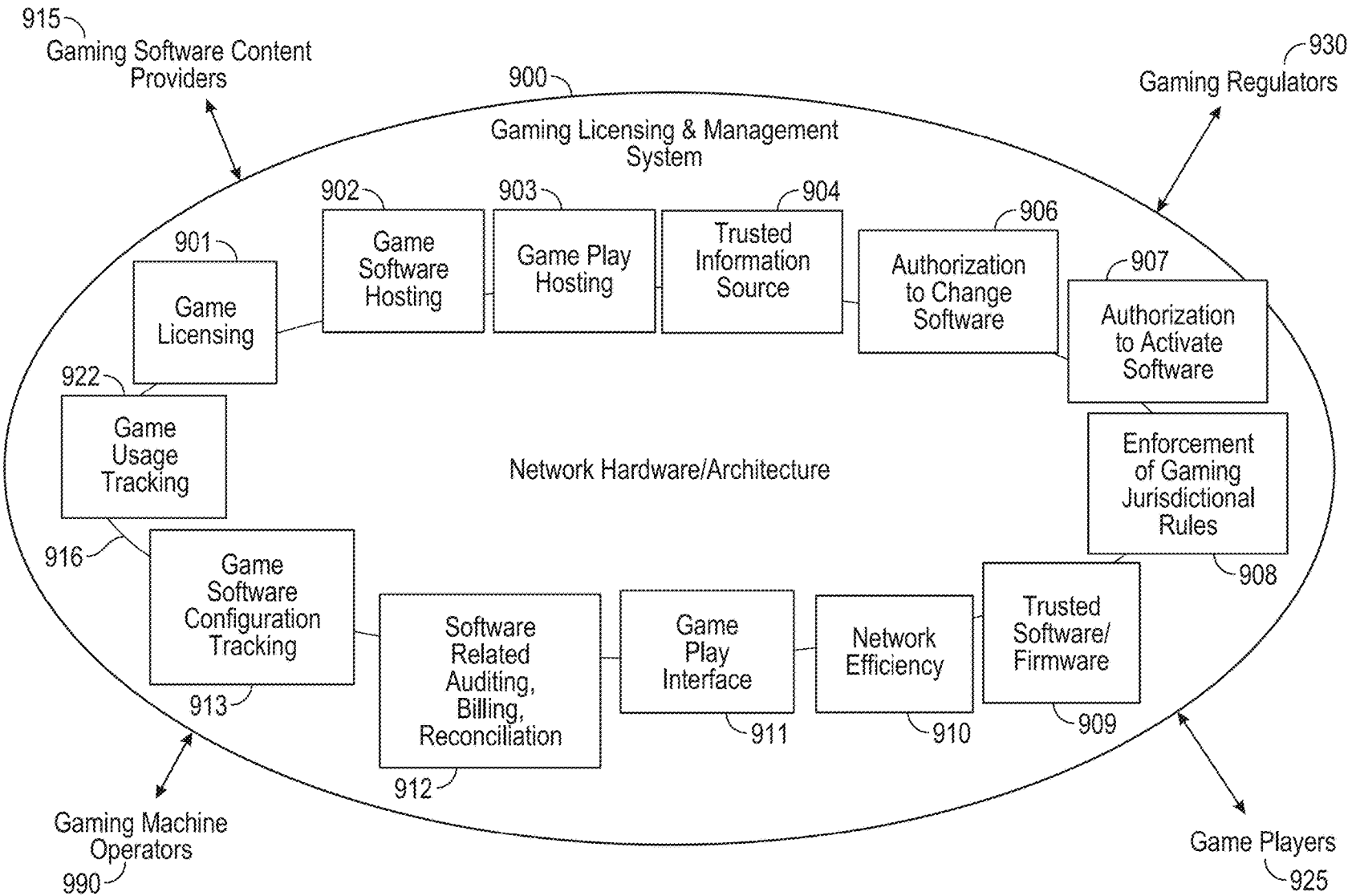
FIG. 9 shows a block diagram illustrating components of a gaming system suitable for implementing an embodiment.

FIG. 9 shows a block diagram illustrating components of a gaming system 900 suitable for implementing various aspects of the embodiments shown and described herein. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 provide rules and regulations that are applicable to the gaming system and receive reports and other information confirming adherence to these rules.

The game software license host 901 may be a server connected to a number of remote gaming devices that provides licensing services to the remote gaming devices. For example, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in use-based licensing schemes, such as a pay-per-use scheme.

In another embodiment, a game usage-tracking host 922 may track the usage of game software on a plurality of devices in communication with the host. The game usage-tracking host 922 may be in communication with a plurality of game play hosts and gaming machines. From the game play hosts and gaming machines, the game usage tracking host 922 may receive updates of an amount that each game available for play on the devices may be played and on amount that may be wagered per game. This information may be stored in a database and used for billing according to methods described in a utility based licensing agreement.

The game software host 902 may provide game software downloads, such as downloads of game software or game firmware, to various devices in the game system 900. For example, when the software to generate the game is not available on the game play interface 911, the game software host 902 may download software to generate a selected game of chance played on the game play interface. Further, the game software host 902 may download new game content to a plurality of gaming machines responsive to a request from a gaming machine operator.

The game software host 902 may also include a game software configuration-tracking host 913. The function of the game software configuration-tracking host is to keep records of software configurations and/or hardware configurations for a plurality of devices in communication with the host (e.g., denominations, number of paylines, paytables, max/min wagers).

A game play host device 903 may include a host server connected to a plurality of remote clients that generates games of chance that are displayed on a plurality of remote game play interfaces 911. For example, the game play host device 903 may include a server that provides central determination of wager outcomes on a plurality of connected game play interfaces 911. As another example, the game play host device 903 may generate games of chance, such as slot games or wager-based video games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

The game play interfaces or other gaming devices in the gaming system 900 may be portable devices, such as electronic tokens, cell phones, smart cards, tablet PCs and PDAs. The portable devices may support wireless communications. The network hardware architecture 916 may be enabled to support communications between wireless mobile devices and other gaming devices in gaming system. The wireless mobile devices may be used to play games of chance, such as described herein.

The gaming system 900 may use a number of trusted information sources. Trusted information sources 904 may include devices, such as servers, that provide information used to authenticate/activate other pieces of information. Cyclic Redundancy Check (CRC) values used to authenticate software, license tokens used to allow the use of software or product activation codes used to activate software are examples of trusted information that might be provided from a trusted information source 904. Trusted information sources may include a memory device, such as an EPROM, that includes trusted information used to authenticate other information. For example, a game play interface 911 may store a private encryption key in a trusted memory device that is used in a private key-public key encryption scheme to authenticate information from another gaming device.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering may be detected.

The gaming system 900 of example embodiments may include devices 906 that provide authorization to download software from a second device to a second device and devices 907 that provide activation codes or information that allow downloaded software to be activated. The devices, 906 and 907, may be remote servers and may also be trusted information sources.

A device 906 that monitors a plurality of gaming devices to determine adherence of the devices to gaming jurisdictional rules 908 may be included in the system 900. A gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRCs, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum wager limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. When a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, e.g., game software approved for use on gaming devices by a local gaming jurisdiction may be required on gaming devices on the gaming machine.

The devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. The software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

In an EGM or EGD, a payout schedule for a wager is a randomized monetary return to the player. Some alternative industry terms for a payout schedule may include paytable, payline, payback percentage or distribution. The phrase "payout schedule" is used and defined here to avoid ambiguity that may be inherent in these alternate terms.

In the simplest terms, a payout schedule can be described as a table of information. Each of the table's Entries (rows) may include at least three elements (columns). One of the elements for an entry may include some identifying information for a wagering event or multiple wagering events. Another element of the entry may include the probability (standard mathematical definition) of the Event occurring. The other important element is the payback value for the wagering event, should the wagering event occur.

The overall Return to the Player (also known as RTP) along with the payback values in the table are generally expressed as either (a) a multiple of the wager or (b) a specific value, such as a dollar (or other currency) amount. All entries in a payout schedule should be expressed in the same terms, as mixing wager multiples and specific values will typically not yield useful information.

In other implementations of a payout schedule, these listed values may not be explicitly present in the table, but may instead be indirectly indicated. For instance, if two six-sided dice were used as a lookup into a payout schedule, the probability of a seven (7) being rolled is higher than any other number. If seven was indicated in the actual payout schedule, it would be indirectly related to the probability of the 7 being rolled (which is ⅙, or 0.1666666 . . . ) Those of skill in the art will recognize that there are many alternate methods of expressing a probability, as well as many alternate methods of specifying a payback value. For instance, rather than specifying the payback value in terms of dollars and cents, or as a multiple of a wager, it could be expressed instead as the value of a "Brand New Car!" or the value of a progressive prize. For clarity, this description will assume that probabilities are real numbers between 0 and 1 inclusive, while payback values will either be multiples of the wager (expressed as percentages) or constant values (such as one dollar ($1)).

Herein, the sum of all probabilities in a payout schedule will equal 1 in a complete payout schedule. It is acceptable to assume that a paytable has a missing entry if the sum of all probabilities is less than 1. This missing entry's probability is equal to one minus the sum of the existing probabilities. The payback value of the missing entry is zero. If the Sum of the probabilities is greater than one, the payout schedule is invalid.

To use a payout schedule, a random value must be generated. This random value must be used such that each entry in the payout schedule can be identified using some transformation of the random value combined with some form of look-up into the payout schedule using the probability of each entry. For example, consider the following payout schedule in Table 1:

TABLE 1

| Event | Probability | Payback Value |
|---|---|---|
| Die Roll = 1 or 2 or 3 | .5 | $0 |
| Die Roll = 4 | .166666. . . | $1 |
| Die Roll = 5 | .166666. . . | $2 |
| Die Roll = 6 | .166666. . . | $3 |

The value of a payout schedule is a sum of products. Each entry in the payout schedule will have its own entry value. This entry value is simply the product of the probability and the payback value. The value of the payout schedule is the sum of all entry values in the payout schedule. Therefore, for the payout schedule of Table 1, its value is calculated as shown below:

$$(0.5*\$0)+(0.166666*\$1)+(0.166666*\$2)+(0.166666*\$3)=\$1.0$$

In this case, if the wager was $1, and the expected value was $1, the casino (and the player) would expect to neither win nor lose money on this game over time.

Note that random values may have different distributions. Most typical gaming devices use a uniform distribution, as a single random number is used to determine some outcome, such as a reel stop position, a wheel position, the value of a playing card, etc. However, some games or gaming devices may be configured to use a non-uniformly distributed random outcome. One such non-uniform random distribution is the Gaussian distribution. A Gaussian distribution (also known as a Normal distribution) is obtained whenever the sum of multiple uniformly distributed random numbers is calculated. For example, if the sum of two 6-sided dice is used to determine how much to pay the player, the outcome of 7 is more common than any other outcome by virtue of the Gaussian distribution of the random result of summing two 6-sided dice. The outcome is still completely random—it's just not uniformly distributed between 2 and 12. The examples used in this description will assume the generation of random numbers that are uniformly distributed unless otherwise specified. Note, however, that this does not preclude the use of non-uniform distributions in alternate embodiments.

In compliance with virtually all US-based gaming regulations, the randomized return must not be based on any previous actions or outcomes. Therefore, a gaming device is not typically permitted to alter the outcome of a random number generator because the gaming device has paid more or less than some target percentage over time. Therefore, the description and embodiments herein will assume the same constraint.

There are a large number of gambling games that are legal to play in the United States that can be reduced to one or more payout schedules. For example, the simple game of Roulette uses a uniformly-distributed random value (the ball landing somewhere on the wheel) along with a set of rules that denote the payout for each of the various possible outcomes. The payout for "black" is usually one-for-one: If you wager $1 on "black", and the ball lands on a "black" number, you will receive $1 for every $1 bet (aka 2 to 1 odds) For this wager, there are 18 black numbers, 18 red numbers, and (hypothetically) 2 green numbers (0 and 00). The frequency of getting black is 18/38, or roughly 47.4%, and has a value of 2. The frequency of getting "not-black" is roughly 52.6%, and has a value of 0. Therefore, the value to the player (the payout schedule value) for "black" wager on roulette is:

$$(2*47.4\%)+(0*52.6\%)=94.8\%$$

In other words, the casino can expect to win (after many millions of wagers) 1-0.948=0.052, or 5.2 cents, for every dollar wagered on "black" in Roulette. Note: Because no units (currency) was set on the payback values, it can be assumed that they are unit-less and, therefore, suitable to be used as a multiplier for the wager.

A classic slot machine follows a similar schedule. Each possible combination of symbols on the screen (or on a payline) has a specific probability of occurring. That combination also has a payback value (return to player). This payback value may be zero, or it may be millions of dollars. Using the same basic formula that was used in the simple wager of "black" on Roulette, the overall payback percentage of a slot machine is determined by summing up the products of each symbol combination's probability of occurring and the payback value for that combination of symbols.

Over a sufficiently long period of time, the value of a payout schedule converges to a constant, designed value (94.8% in the previous Roulette example). For purposes of calculating the theoretical return to player (RTP) of a game, regardless of the individual details comprising a payout schedule (Roulette vs. Slot Machine vs. other), if the values of two payout schedules (as calculated above) are the same, then the theoretical RTP for the wager will be the same. As such, the use of the term "value of the payout schedule" is inclusive of every possible way that a payout schedule can be constructed.

For instance, if an example stated: "Carrying out a predetermined action (e.g., collecting a Blue Diamond, eating a Power Pill, etc.) results in the evaluation of a payout schedule with a value of 91%, no assumption should be made about how the payout schedule is constructed. In one embodiment, the rolling of a die may be used as the value of the payout schedule. In another embodiment, a slot machine outcome may be used to determine the value of the payout schedule. In yet another embodiment, the spinning of a virtual wheel may be used to determine the value of the payout schedule. For example, a randomized lookup into a lookup-table may be used to establish the value of the payout schedule.

Even if two payout schedules have the same value, the payout schedules may have very different volatilities. In the simplest terms, a payout schedule with a higher volatility will require more wagers to converge to some given confidence interval (standard statistical definition) around the payout schedule value than a payout schedule with a lower volatility. In many (if not most) gambling games, combining the theoretical payback value with the volatility is a significant part of the craftsmanship behind mathematical game design. Unless noted otherwise, the volatility of a payout schedule does not affect the use of the term payout schedule—two payout schedules with the same value may be considered equivalent in various alternate embodiments and examples described herein. Various terms such as counters, tokens, achievements, etc. will all be called Counters in this description.

Herein, the phrase "wagering event" means a wager instance that is generated as a result of a player interacting with a wagering opportunity, or any wagering opportunity within a game that is recognized by the game as a wagering event. Wagering opportunities may include hardware-based actions such as: pressing a button, pulling a trigger, touching the screen, etc. Wagering opportunities may also include, but are not limited to, virtual events (events that occur virtually within a video game), such as touching or attempting to touch any game object with a player-controlled avatar (humanoid, vehicle, held weapon or fist, etc.) or having the player's avatar come within a certain proximity of the game object, firing a projectile at any game object (either requiring the projectile to hit or simply be fired, or alternately having the projectile aimed such that it eventually comes within a certain proximity to a game object), making a selection or a move or as the result of making a selection or a move (such as placing an "X" on a Tic-Tac-Toe board, moving your piece in a Monopoly game, sliding a tile or gem in a Match-3 game, etc.), and in general taking any action within a game or allowing any interaction to occur within a game, at any point in time or during or after any duration of time. For any of these opportunities, if a wager has been made prior to, simultaneous with or subsequent to their occurrence, and directly or indirectly because of their occurrence, the combination of the wager and the occurrence becomes known as a wagering event. There may be a myriad of possible wagering opportunities within a game. Part of the game's design will be determining which (and when) opportunities may be wagered upon, thereby defining the difference between a wagering opportunity and a wagering event. Some events may not be or include a wagering opportunity until some specific time or upon the occurrence of some other predicate event(s).

According to one embodiment, some wagering events may occur less frequently, may be associated with a greater time delay within the game, may require a greater degree of dexterity or cleverness and/or may generally be more subjectively difficult to accomplish. Some wagering events may be associated with more than one such attribute. Naturally, such wagering events may have a higher perceived value to a player than wagering events that are associated, for example, with a higher frequency of occurring and/or that require a comparatively lesser degree of dexterity, cleverness and/or that are comparatively easier to accomplish.

In any event, regardless of such attributes that may be associated with one or more wagering events, the game must be considered "fair". A primary tenet regarding fairness is that the rules of the game must be completely described to the player, such that the player may make an informed decision whether or not to play the game based on how the game is played. This rule applies to all known regulated gaming jurisdictions. The gaming embodiments shown and described herein are fair and it is assumed that the rules of the game are clearly described to the player.

Also, the game must never pay out so much money that the casino (or other gaming establishment) will consistently lose money to a player that, through luck and/or consistently skillful actions, accomplishes many or all of the wagering events. While it is acceptable, for a player that consistently accomplishes most or all wagering events that are subjectively more valuable, to win more money (including more than he or she put into the gaming machine) than another player that accomplishes none or a limited number of such subjectively more valuable wagering events, the game must be designed in such a manner as to guarantee that the winnings over time, for any player, will not cause the casino to lose money. The embodiments shown and described herein allow for the game designer to guarantee that no player, however, lucky, clever, dexterous or skillful, cannot win more than 100% of his or her wagers over a significantly long period of time and over many iterations of the game. This proposition may be called, in short-hand, the Unacceptably High Payback Rule.

Frequently within a game, there will be wagering events that may be subjectively perceived as being more valuable, harder to accomplish, that occur less frequently (collectively, "harder" wagering events) and there will be wagering events that may be subjectively perceived as being comparatively less valuable, easier to accomplish, that occur more frequently (collectively, "easier" wagering events). For example, in the classic matching game Bejeweled™, matching 3 gems is considered to be easier than matching 4 gems. Also, opportunities to match 3 gems may occur more frequently than do opportunities to match a greater number of gems (4, 5, 6, or 7, for example). In a first-person shooter game, a head shot (smaller target, more difficult to hit) may be considered to be harder and a body shot (larger target, comparatively easier to hit) may be considered to be easier. Because of basic human nature, players typically expect larger rewards for harder activities.

According to one embodiment, one way to address this desire for a larger reward is to assign a different and higher-valued payout schedule to harder wagering events. Such a paradigm allows for a consistently greater return to the skilled player and for an occasionally greater return for the lucky player. Other embodiments are configured to enhance such a paradigm to both enhance all players' experiences and to protect the casino.

According to one embodiment, each individual wager, placed through the gaming machine receiving some player interaction when the player encounters a wagering event, should never have an expected RTP that falls below a specified minimum (such as 75% in Nevada), regardless of game state or game history. According to another embodiment, the overall RTP, over the life of the game, should not exceed some specified maximum, most likely mathematically capped at 100%, even if the player were to successfully and consistently accomplish all available skillful actions required during wagering events. It is to be understood that, over the short term, any player may be rewarded more than his or her wagers. However, even if the luckiest and most skilled player in the world were to play a game machine or configured according to one or more of the embodiments shown and described herein for an extended period of time, that player would never be rewarded a return that cost the casino (or other operator) money.

Notwithstanding, according to one embodiment, the expected RTP of an individual wagering event within a game may be larger for a harder wagering event than the expected RTP for a comparatively easier wagering event within the same game. It is these harder (and/or less-frequently occurring) wagering events that are associated with a better (for the player) RTP, that keep the player engaged in the game at hand, and that heighten his or her excitement during game play. Engaging gameplay is usually an indicator of higher revenue in the gaming industry. Some (easier and/or frequently occurring) wagering events may have an expected RTP of (for example) 75%, while other (harder, and/or less frequently occurring) wagering event may have an expected RTP of, for example, 85% (or even higher than 100%, in certain circumstances) associated therewith.

Consider the exemplary payout schedule table shown in Table 2:

TABLE 2

| Payout | Probability | Range | RTP (Calculated) |
|---|---|---|---|
| 0 | 80% | 0. . .79 | 0 |
| 2 | 10% | 80. . .89 | .20 |
| 5 | 5% | 90. . .94 | .25 |
| 10 | 5% | 96. . .99 | .50 |
| Total RTP (Sum): | | | .95 (95%) |

In this example, a random number is generated and scaled to a value between 0 and 99 (0 . . . 99). Using the "Range" column, the scaled number (0 . . . 99) is used to determine the payout amount to award the player. The "RTP (calculated)" column for each row is simply the product of the Payout and the probability for that row. The sum of the values in this RTP column represents the overall total RTP for the entire payout schedule.

According to some embodiments, lower RTP payout schedules may be enabled for some wagering opportunities and/or less successful players while comparatively higher RTP payout schedules may be enabled for other wagering opportunities and/or comparatively more successful players. In some embodiments, lower RTP payout schedules may be enabled for wagering opportunities that occur often or that the player is statistically more likely to accomplish (i.e., easier wagering opportunities) while higher RTP payout schedules may be enabled for one or more wagering opportunities that occur comparatively less frequently and/or that the player is less likely to successfully accomplish (i.e., harder wagering opportunities). For example, lower RTP payout schedules may be enabled for easier wagering opportunities while higher RTP payout schedules may be enabled for harder wagering opportunities. Easier and harder wagering opportunities may be measured, subjectively or objectively, by the amount of game play time required to reach them, cleverness of the player, by the amount of manual dexterity of the player, by the reaction time or speed of the player and/or by any other metric that results in a statistical differential between the rate of unsuccessfully completing a predetermined action or actions upon encountering a predetermined wagering opportunity and the rate of successfully completing the action or actions upon encountering the same predetermined wagering opportunity during game play. Indeed, the player may accept a lower rate of return for accomplishing tasks he or she (and/or the game designer) perceives as easier in exchange for a comparatively higher rate of return for accomplishing tasks he or she (and/or the game designer) perceives as being harder, wagering opportunities that conclude a chapter of the game's narrative or that are thematically significant to the game.

Figure 10:
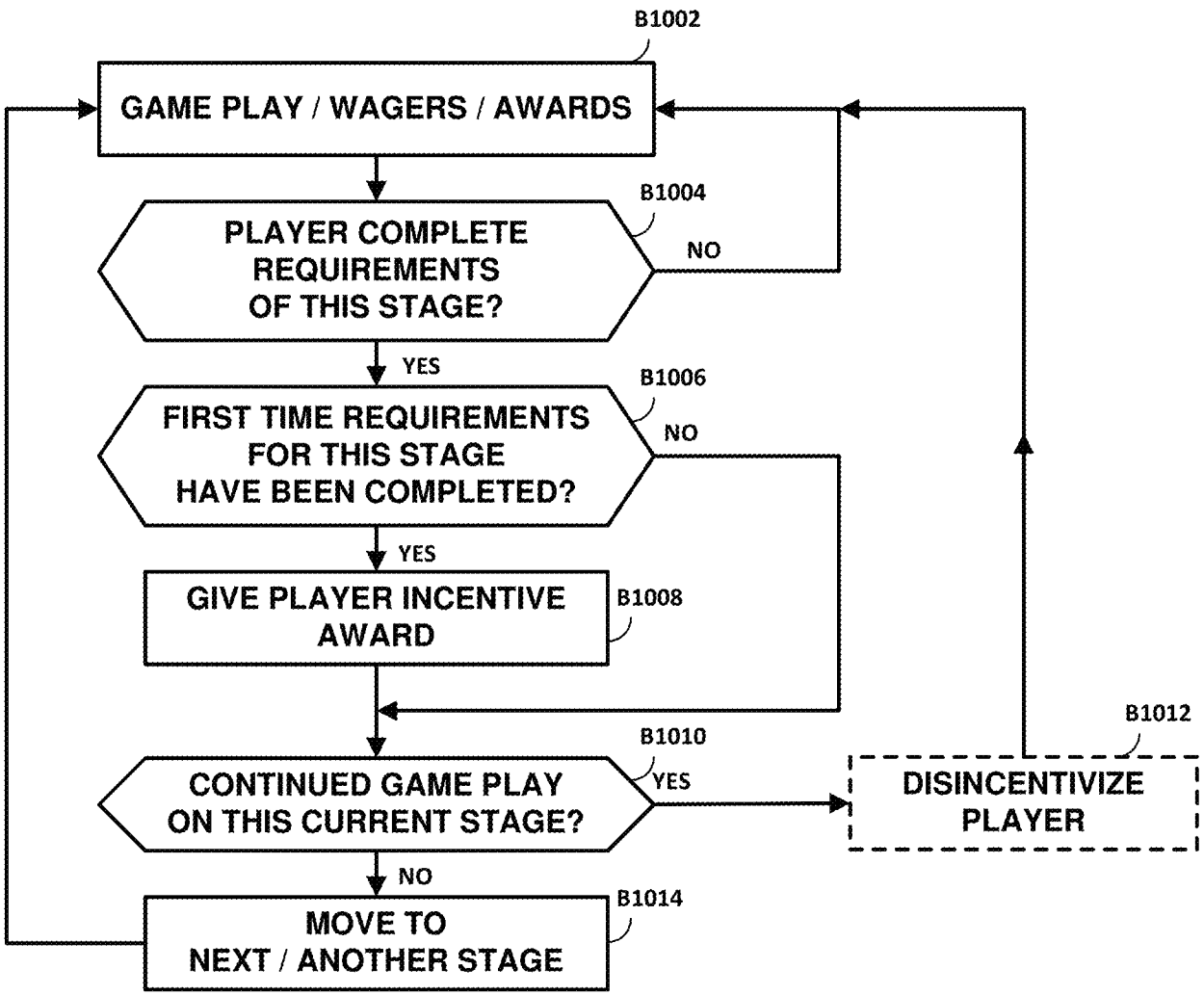
FIG. 10 is a flowchart of a computer-implemented method, according to one embodiment.

FIG. 10 is a flowchart of a computer-implemented method, according to one embodiment. As shown therein, block B1002 calls for game play, wagering and rewarding players. That is, game play is ongoing, with the regulated gaming machine receiving (via a user interface), (more or less skillful, in one embodiment) player interactions with in-game assets, which selectively generates wagering events whose outcome is determined by random chance, according to one or more payout schedules defining one or more predetermined RTPs. In greater detail, when the regulated gaming machine receives a player interaction with an in-game asset, a wagering opportunity is generated. If the player's interaction was successful, the interaction may be considered to be successful and a wagering event may be generated. If the player's interaction was unsuccessful, the interaction may be considered unsuccessful and a wagering event would not, in one embodiment, be generated. In one embodiment, skillful player interactions result in successful interactions and unskilled or less than skillful result in unsuccessful interactions. A successful interaction in which the objective of the interaction (picking up a power pill, collecting coins, steering a vehicle over an obstacle, killing a zombie, etc.) was achieved. Conversely, an unsuccessful interaction in which the objective of the interaction was not achieved (the bullet missed the zombie, ammunition was not picked up, a health bar was not acquired, or the vehicle crashed into the obstacle, for example).

According to one embodiment, the game that is the subject of the game play in B1002 is a wager-based game having a plurality of stages. Herein, the terms "stage" or "stages" are terms that are intended to be inclusive of game levels, game areas or any other logical, strategic, or narrative-based divisions within the game that the player either progresses through as the game unfolds or can choose to go, such as a different area of a map within a game. As noted above, some players tend to perseverate at a favorite level, in a preferred area or a familiar stage. They are familiar with the actions required are content to stay in known territory, repeating familiar actions. The embodiments shown and described herein address this issue, thereby encouraging players to take advantage of the game's full potential. In turn, this heightens their engagement and interest in the game, causing them to play longer.

According to one embodiment, game play and wagers are enabled at a current stage of the game. If the player just started the game, it is likely that he or she is at the first stage, level or area (hereinafter, collectively, "stage"). Most games' stages have requirements, acts that must be carried out, to complete the requirements of the stage and enable game play to transition to another or next stage. Examples include requirements that all power pills have to be collected, all, most or selected zombies killed, a specific number of points earned, and the like. At block B1004 in FIG. 10, it may be determined whether all requirements for the current level have been satisfied or completed. If not (NO branch of B1004), game play may revert to B1002, to enable the player to keep playing at the current stage until all requirements (YES branch of B1004) have been completed. Once it is determined that all requirements for the current level have been satisfied or completed, it may then be determined, as shown at B1006, whether this is the first time, during the current game session, that these requirements for the current stage have been completed.

In other words, this may be the first time that the player has completed all requirements for the current stage in this game session or the user may have previously, during the current game session, completed all requirements of the current stage and may have decided to remain on this stage, without causing the game to transition to another or next stage. To promote the exploration of the different stages of the game and to encourage the player to discover the full capabilities and scope of the game, the player may be offered an incentive award to cause the game to transition from the current and now completed stage to the next or another stage in the game. This incentive is shown at B1008, reached via the YES branch of B1006. If, however, the player has previously completed all requirements for the current stage (i.e., this is not the first time, during this game session, that all requirements of the current stage have been completed), the incentive award of B1008 is not offered or awarded, whereupon game play proceeds to B1010. At block B1010, it may be determined whether the player wishes to continue game play on the current stage. This determination may be made by a query-response cycle between the regulated gaming machine and the player or simply through the received player interactions that evidence continued game play on the current level. If the player does not desire to continue playing on the current stage (NO branch of B1010), game play may transition to the next stage or another stage within the game, as shown at B1014, whereupon game play reverts to B1002 for this new/other stage of the game. If, however, continued game play on the current stage is desired (YES branch of B1010), the game does not transition to the next or another stage and the player may be permitted to continue game play, wagering and receiving rewards in the current stage, as evidenced by the arrow reverting to B1002 from B1010. According to one embodiment, if the player has completed all requirements for the current stage (game play has reached a state that may be a "stage complete state"), yet wishes to remain on the current stage, the player may be disincentivized, as shown at B1012. Block B1012 is shown in dashed lines, to convey that the player may be, but need not be, disincentivized. According to one embodiment, the disincentive may include any detriment to the game or player that the player, all other things being equal, would rather avoid. Monetary penalties (i.e., taking away the player's already earned money or player credits) are likely not imposed but are possible.

Figure 11:
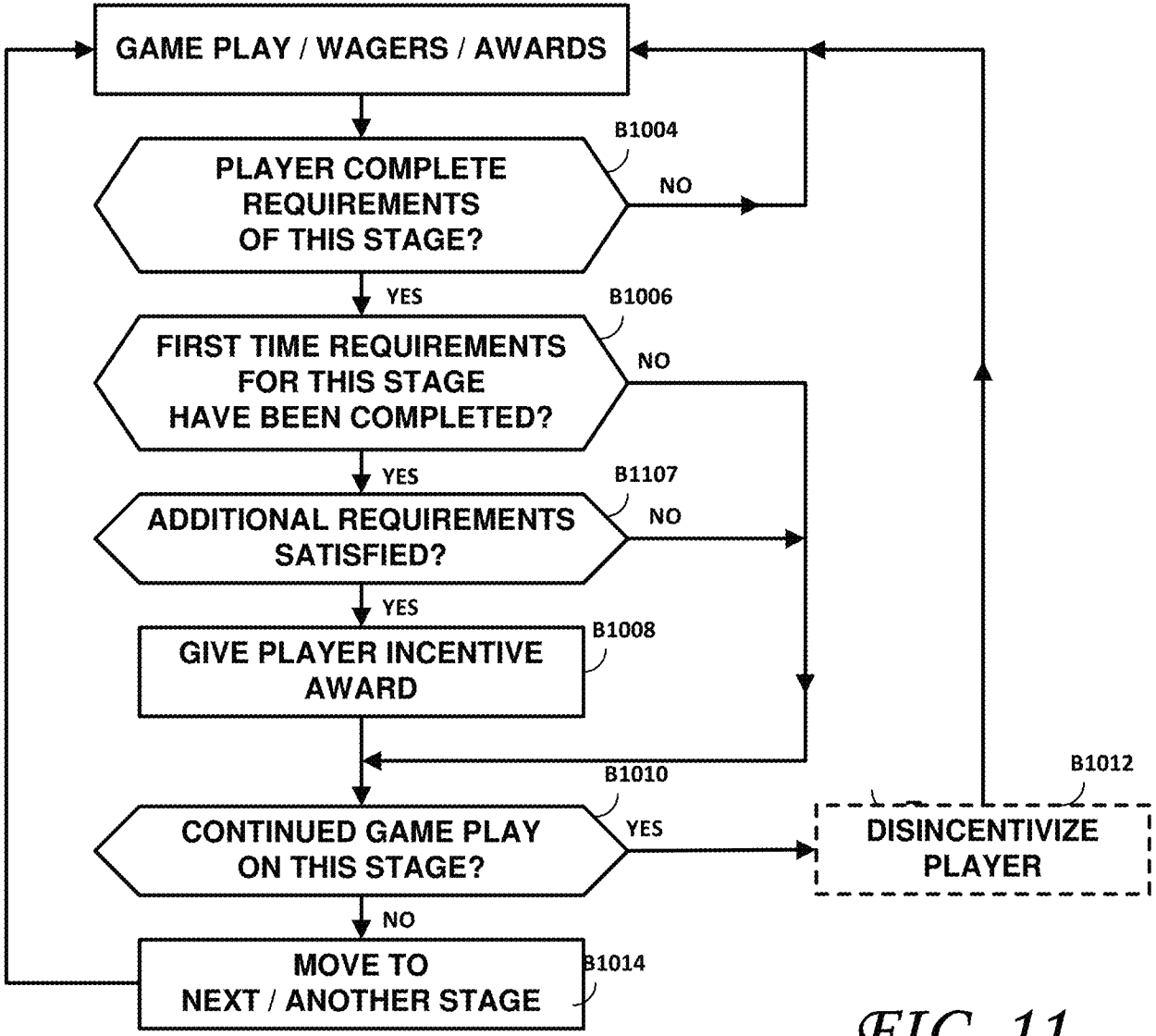
FIG. 11 is a flowchart of a computer-implemented method, according to one embodiment.

FIG. 11 is another flowchart of a computer-implemented method, according to one embodiment. FIG. 11 is identical to FIG. 10, but for block B1107, interposed between blocks B1006 and B1008. After determining that this is the first time that all requirements for the current stage have been completed, an additional step of determining whether additional requirements have been satisfied at B1107. If not, the method may forgo offering or awarding the incentive award and proceed to B1010, to determine if continued game play on the current level is desired. If this is the first time that all requirements for the current stage have been completed and all additional requirements have been satisfied, the incentive award may be offered and awarded to the player in B1008. For instance, the player may have killed all the zombies required for transitioning to a next level but may not have picked up two additional ammunition magazines (the additional requirements), which he or she will need in the next stage. Likewise, all requirements for transitioning to a next stage of the game may have been satisfied in B1006, but the player has not earned three stars, which will enable him or her to do something else in a next or another level in the game. Indeed, although the player may have completed all requirements for transitioning game play to another stage (i.e., the game has reached the stage complete state), additional requirements may be imposed for the player to be offered, and receive, the incentive award of B1008. Block B117 is intended to cover all such additional requirements.

Figure 12:
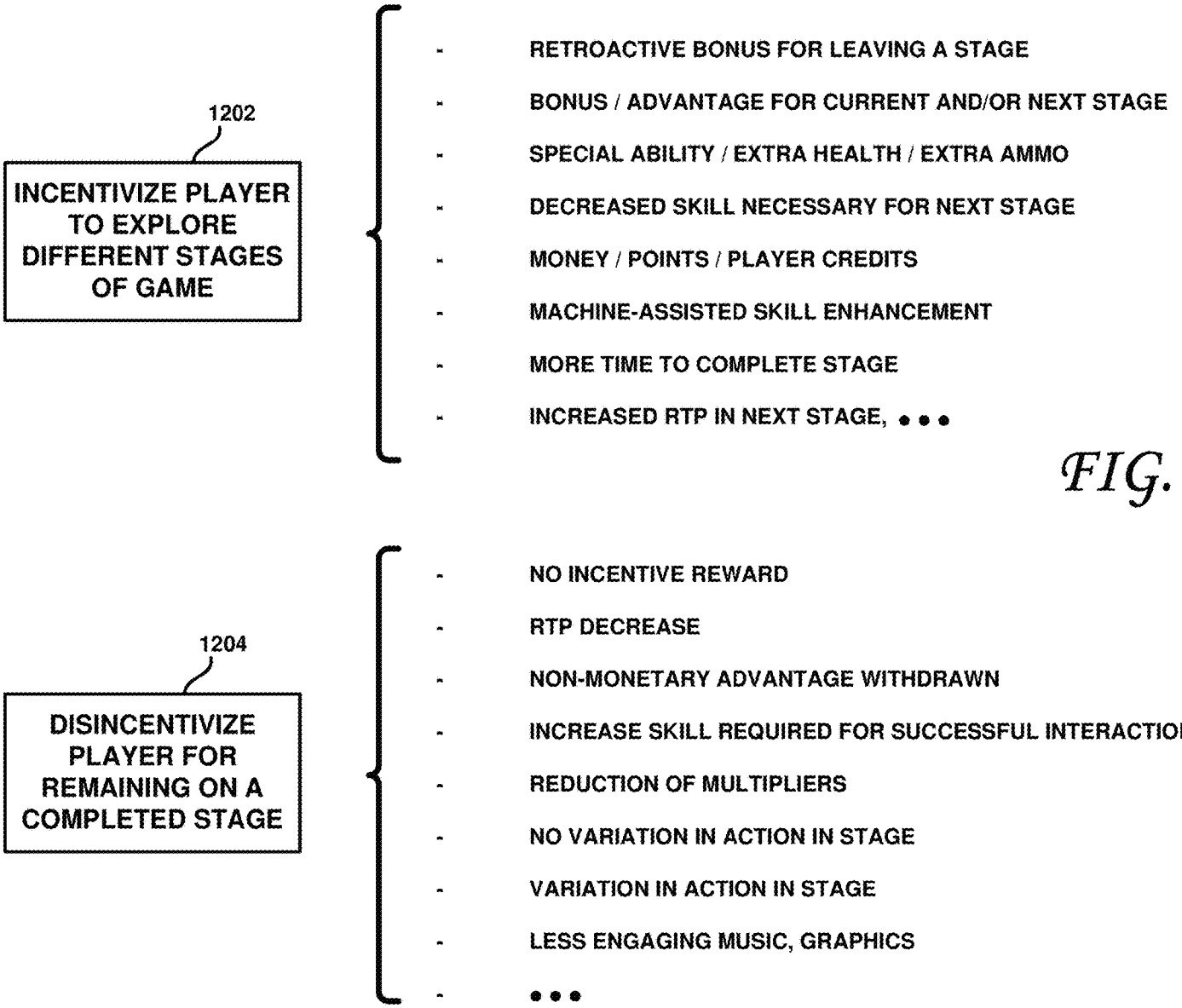
FIG. 12 is a diagram illustrating potential incentives and disincentives, according to one embodiment.

FIG. 12 shows a few of the possible implementations of the incentive award 1202 and of the optional disincentive 1204. It is to be noted that the listed examples are not intended to constitute the entire universe of possible incentives or disincentives, and that others will occur to those of ordinary skill in the art and/or may become evident upon consideration of the nature of the game to which embodiments may be applied. The incentive award 1202 may comprise, for example, a retroactive bonus for leaving the current stage, a bonus or other strategic advantage for current and/or next stage, some special ability/extra health/extra ammo and the like in the next stage, decreased skill necessary for the next stage (it becomes easier to achieve the objectives in the next stage), money/points/player credits, machine-assisted skill enhancement (the regulated gaming machine nudges player interactions to exhibit greater skill or precision that the player actually has), more time to complete stage, and/or, for example, a bump in the RTP percentage in the next or other stage. For example, if the coordinates of a target in a game are at coordinates (123, 456) and the player's interactions are interpreted by the regulated gaming machine as aiming the player's weapon in the game to point to coordinates (121, 461)—and thereby missing the target—the aforementioned machine-assisted skill enhancement may nudge the player's aim by the required x, y deltas of (+2, −5) to re-direct the player's aim directly on target. Other incentives are possible.

The optional disincentive 1204, according to one embodiment, may operate to discourage the player having already mastered or completed a stage, to remain on that stage. For example, the disincentive may include no incentive reward, an RTP decrease in the next stage the game transitions to, the withdrawal of any or selected non-monetary advantage, an increase in the skill required for successful interaction with the in-game assets in the next or other stage (should the game ever transition to such next or other stage) and/or a reduction of any multipliers earned or to be applied. Other, more subtle changes may be made to the game that collectively may discourage the player from persevering on a single stage. For example, the game play may become mostly repetitive which, over time, may cause the player to become bored and want to move on. Reduced awards may also be offered for successful interactions in such a case. Conversely, the acts required in the stage may be purposefully varied, thereby discouraging the player that tries to spend too long in a stage where he or she has memorized and mastered all necessary moves and actions to achieve the stage's objectives. Other disincentives may include, for example, less engaging music and/or graphics if the player persists too long at a given stage. Again, other disincentives will occur to those of skill in this art and/or may reveal themselves by the very nature and narrative of the game.

Figure 13:
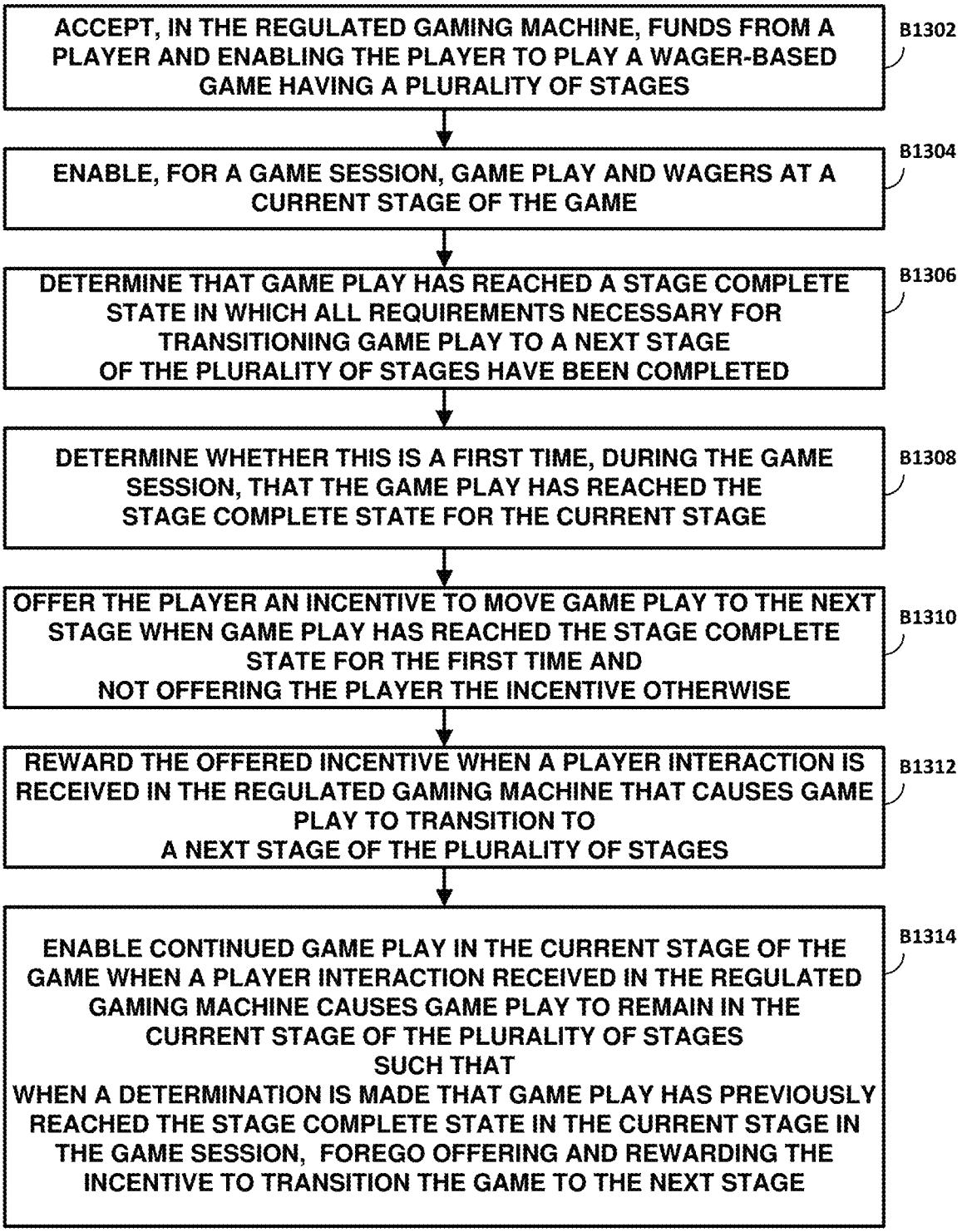
FIG. 13 is another flowchart of a computer-implemented method, according to one embodiment.

FIG. 13 is a flowchart of a computer-implemented method, according to one embodiment. As shown at block B1302, the computer-implemented method may comprise accepting, in the regulated gaming machine, funds from a player and enabling the player to play a wager-based game having a plurality of stages. Block B1304 calls for enabling, for a game session, game play and wagers at a current stage of the game. Then, it may be determined that game play has reached a stage complete state in which all requirements necessary for transitioning game play to a next stage of the plurality of stages, as shown at B1306. Thereafter, a determination may be made whether this is a first time, during the game session, that the game play has reached the stage complete state for the current stage, as shown at B1308 in FIG. 13. The regulated game machine may then offer the player an incentive to transition game play to the next stage when game play has reached the stage complete state for the first time and may forego offering the player the incentive otherwise, as called for at B1310. Block B1312 then rewards the offered incentive when a player interaction is received in the regulated gaming machine that causes game play to transition to a next stage of the plurality of stages. Continued game play may then be enabled in the current stage of the game, as shown in B1314, when a player interaction is received in the regulated gaming machine that causes game play to remain in the current stage of the plurality of stages such that when a determination has made that game play has previously reached the stage complete state in the current stage in the game session, the gamine machine foregoes offering and rewarding the incentive to transition the game to the next stage.

According to further embodiments, the incentive may comprise money, money equivalent or other indicia of value. Conversely, the incentive may be non-monetary. For example, the incentive may comprise an advantage to the player in the next or another stage, level, area, etc. The incentive may comprise a retroactively-applied advantage in the current stage. Offering the player the incentive may be carried out when game play has reached the stage complete state for the first time and when additional requirements are satisfied. The incentive may include an increased RTP percentage in the next or another stage. The wager-based game may be a skill and wager-based game and the incentive may include a gaming machine-assisted skill enhancement for game play in the next or another stage. The computer-implemented method may further comprise imposing a disincentive for remaining in the current stage after game play has reached the stage complete state for the first time. The disincentive may also be non-monetary.

Figure 14:
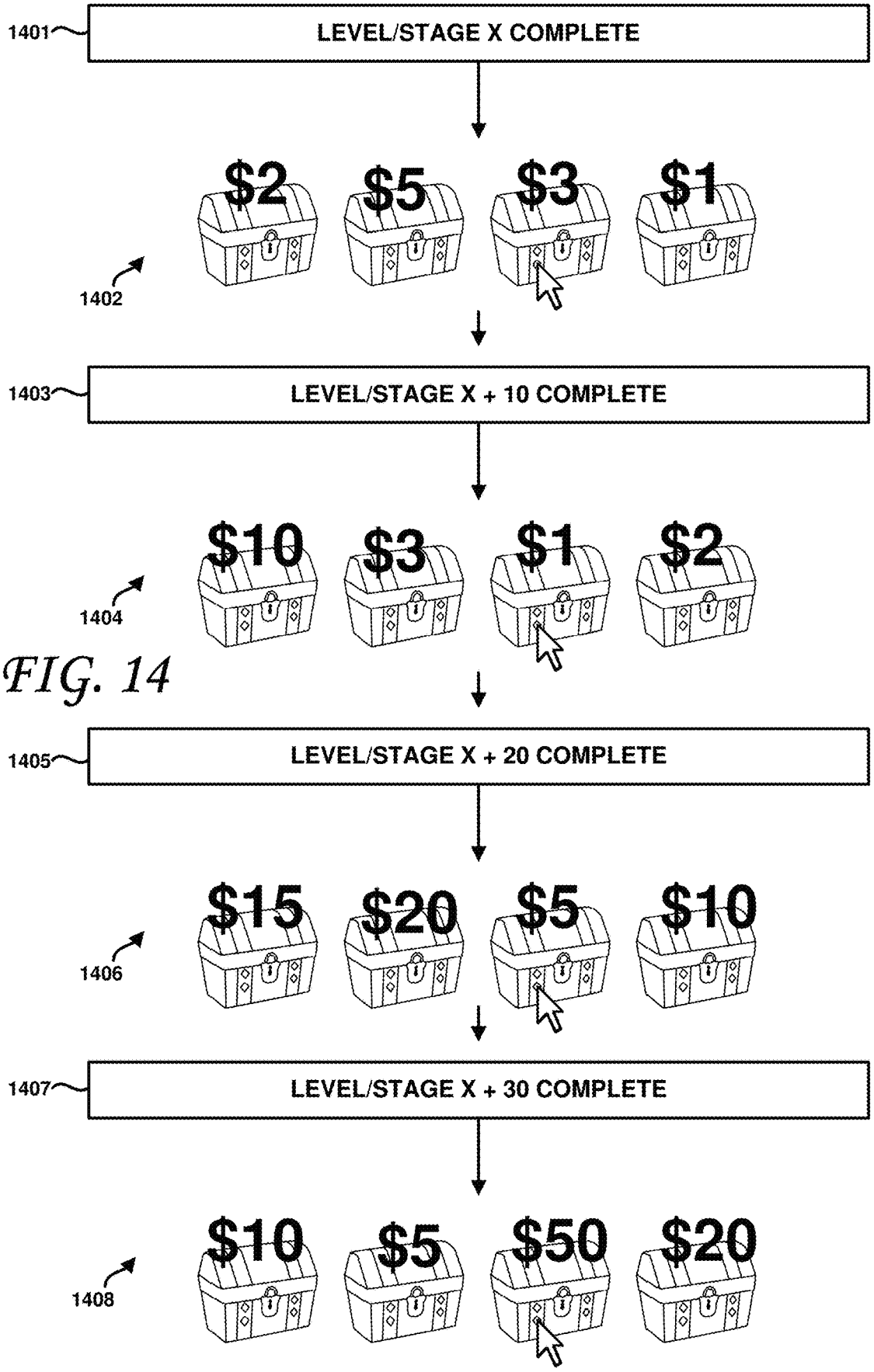
FIG. 14 is a diagram illustrating aspects of a computer-implemented method according to one embodiment.

FIG. 14 is a diagram that illustrates aspects of a computer-implemented method of operating a gaming machine according to one embodiment. As previously noted, the gaming machine may be a dedicated, regulated gaming machine on a casino floor. Alternatively, the gaming machine may be or may include a general purpose computing device that is reconfigured, by software and/or hardware, as a regulated, wager-enabled gaming machine, jurisdictional and regulatory considerations permitting. Such a gaming machine may accept funds from a player and enable the player to play a wager-based game having a plurality of levels or stages and/or any other type of partitioned game. For example, the game may include a number of levels, where lower levels are shorter or easier than comparatively-lower levels. Alternatively, higher stages or levels may simply depict and offer interaction with aspects of the game that are further along the game's narrative than earlier stages or levels. The game may also be partitioned according to some aspect, characteristic or state of a player's avatar. For example, the game may transition from one level or stage to another when the player's avatar has performed all required tasks, solved a predetermined problem, acquired sufficient experience, health units, armor, ammunition, driving skill points or has scored a predetermined number of confirmed kills or collected other in-game assets or points.

However divided into levels, stages or otherwise partitioned, the player may be enabled, for a game session, to play the game and make wagers in a first level or stage of the plurality of levels or stages of the game. At some point during game play, it may be determined that game play in the first stage has reached a first stage complete state in which all requirements necessary for transitioning game play from the first stage to a second stage of the plurality of stages have been completed. Such first stage complete state will necessarily vary from game to game. However, such first stage complete state will be that state that enables game play to transition from a first stage to another, second stage. Herein, the "first" stage need not be the ordinal first stage of the game (in that there are no stages before it); the term is used herein merely to distinguish the stage from other, most often later, more advanced stages in the game or further along in the game's narrative. According to one embodiment, the game, having reached the aforementioned first stage complete state 1401, may provide the player with an opportunity to win one of a plurality of prizes—or may simply award the player a random prize, without further player engagement. Such an opportunity rewards the player for completing the current level or stage adds yet another incentive for the player to continue his or her level exploration and rewards the player's continued game play. The prize, according to one embodiment, may be monetary and/or a monetary-equivalent prize. Indeed, the reward may be money or some other reward that has in-game value and/or that may be redeemed for money. The prize, according to one embodiment, may be one of a plurality of such monetary or monetary-equivalent prizes as shown at 1402 in FIG. 14, with the highest prize of the plurality being denoted as the first top prize. As shown at 1402, the plurality of prizes include prizes for $1, $2, $3 and $5. In the implementation shown in FIG. 14, these prizes made available to the player in a pick'em configuration, a forced-choice configuration in which the player is invited to select one of the displayed treasure chests to reveal the previously-hidden prize value. In the treasure chests shown at 1402, the first top prize is $5, which the player has a one in four chance of picking. After the player picks one of the treasure chests, therefore, he or she is awarded a random one of the plurality of first monetary or monetary-equivalent prizes—which may or may not be the first top prize.

Thereafter, game play may continue in a second level and/or stage of the game, the second stage being, according to one embodiment, a later (or at least another) stage in the game session that is different from the first stage. As shown at 1403 in FIG. 14, the second stage is shown as being 10 levels/stages past the level stage shown at 1401. Therefore, the "second stage" need not immediately follow the previously-discussed "first stage". At some point, game play is determined to have reached the second stage complete state 1403 in which all requirements necessary for transitioning game play from the second stage to a third stage of the plurality of stages have been completed. As shown at 1404, the gaming machine may then provide the player with an opportunity to win one of a plurality of second monetary or monetary-equivalent prizes. As shown, the plurality of second monetary or monetary-equivalent prizes may comprise a number of randomly-awarded prizes, with a highest one of the second plurality of monetary or monetary-equivalent prizes being denoted as the second top prize that is higher (or otherwise more valuable) than the first top prize. Indeed, as shown in FIG. 14, the first top prize shown at 1402 (at Level/Stage X Complete state) is $5, whereas the second top prize shown at 1404 is $10, which is higher than the first top prize of $5. Therefore, as shown in FIG. 14, the potential top winning offered upon the player achieving the Level/Stage X+10 Complete state 1403 is $10. Therefore, as all other (namely, the $1, $2 and $3) prizes are identical to those awardable at 1402, the RTP of the game increases somewhat as the player reaches higher levels/stages. In another embodiment, the probabilities may be adjusted such that the RTP remains identical across levels or stages or increases stepwise over groups of levels or stages, even though the top prize has increased. In other words, as the top prizes increases, the odds of winning that top prize may, according to one embodiment, become increasingly long.

Upon achieving another or, in this case, later level/stage complete state, such as the X+20 level/stage complete state 1405 or the X+30 level/stage complete state 1407, the gaming machine may offer other pluralities of prizes, such as shown at 1406 and 1408, respectively. As shown at both 1406 and 1408, not only does the top prize become progressively higher ($20 and $50, respectively), but the other potential awards may change as well. The probabilities may be maintained constant or may be adjusted as needed to hit the desired RTP. In any event, the player is incentivized to continue playing the game and progressing through the levels/stages thereof, as the potentially winnable top prize continues to increase.

Figure 15:
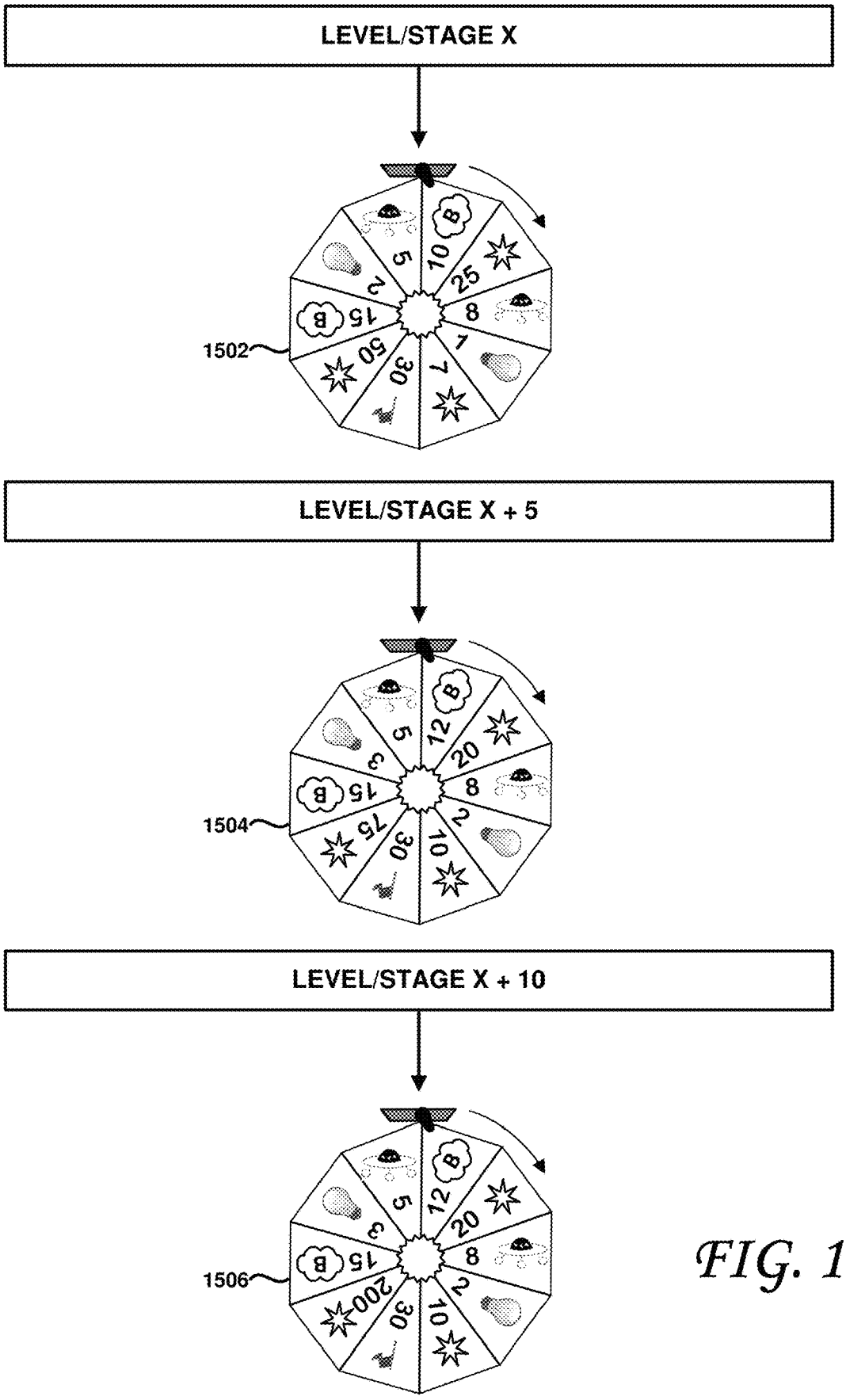
FIG. 15 is another diagram illustrating aspects of a computer-implemented method according to one embodiment.

FIG. 15 is another diagram illustrating further aspects of a computer-implemented method of operating a regulated gaming machine, according to one embodiment. As shown therein, instead of a pick'em presentation, a spinning reel or wheel is presented, which randomly stops on one of a plurality of sections associated with different monetary or monetary-equivalent prizes. As shown in FIG. 15, the top prize increases as the player makes his or her way through the constituent levels/stages of the game. As shown at 1502, the top prize that may be won after reaching a level/stage X complete state is $50. Upon reaching the level/stage X+5 complete state, the top prize is $75 and upon reaching the level/stage X+10 complete state, the top prize is $200. According to one embodiment, the RTP may be allowed to increase or may be kept constant, as the game designer wishes. Even if the odds of winning the top prize become increasingly long, players may be incentivized to continue playing, in the hopes of reaching ever-higher levels/stages and being given the opportunity to win increasingly larger top prizes.

Figure 16:
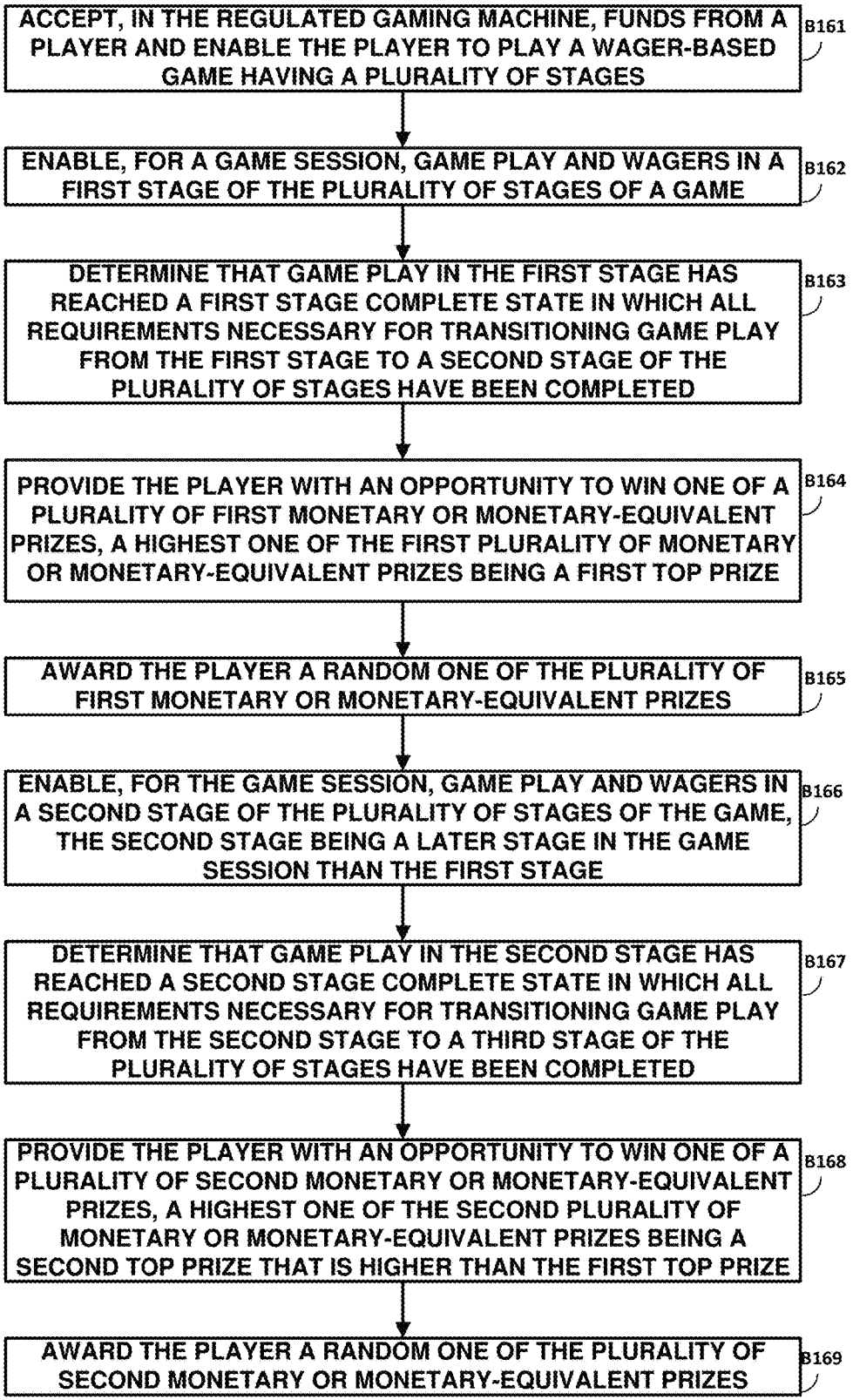
FIG. 16 is a flowchart of a computer-implemented method according to one embodiment.

FIG. 16 is a flowchart of a computer-implemented method according to one embodiment. As shown at block B161, the computer-implemented method calls for accepting, in or by the regulated gaming machine, funds from a player and enabling the player to play a wager-based game having a plurality of levels or stages. In block B162, game play and wagers may be enabled, for a game session, in a first stage of the plurality of stages of a game. At B163, it may be determined that game play in the first stage has reached a first stage complete state in which all requirements necessary for transitioning game play from the first stage to a second stage of the plurality of stages have been completed. It is to be noted that a "stage", according to one embodiment, may include several levels or may indicate some other partitioning of the game play along, for example, narrative lines. At B164, the player may be provided with an opportunity to win one of a plurality of first monetary or monetary-equivalent prizes. As discussed and shown relative to FIGS. 14 and 15, the highest one of the first plurality of monetary or monetary-equivalent prizes may be called the first top prize. Thereafter, as shown at B165, the player may be awarded a random one of the plurality of first monetary or monetary-equivalent prizes—the prize awarded may be the first top prize or any one of the other constituent prizes of the first plurality of monetary or monetary-equivalent prizes. The computer-implemented method of FIG. 16 may then proceed to B166, in which game play and wagers may be enabled, in the current game session, in the second stage of the game, the second stage being, for example, a later stage in the game session than the first stage and need not immediately follow the aforementioned first stage. At B167, it may be determined that game play in the second stage has reached a second stage complete state in which all requirements necessary for transitioning game play from the second stage to a third stage of the plurality of stages have been completed. Thereafter, as shown at B168, the player may be provided with an opportunity to win one of a plurality of second monetary or monetary-equivalent prizes, through a pick'em presentation, a rotating reel or wheel or via most-any engaging graphic. The highest one of the second plurality of monetary or monetary-equivalent prizes may be called the second top prize and may be, according to one embodiment, higher (or otherwise more valuable or desirable) than the first top prize. In one embodiment, one or more of the top prizes may have no value outside of the game or may indeed have no immediately value outside of the game. In one embodiment, for example, the prize awarded may have utility in or enable later-occurring wagers. For example, the prize awarded may be a gem, weapon, armor, upgrade or any other item that is necessary or useful in a later-occurring level, stage and/or wager. As shown at B169, the player may then be awarded a random one of the plurality of second monetary or monetary-equivalent prizes.

According to further embodiments, the plurality of first monetary or monetary-equivalent prizes may be identical to the plurality of second monetary and monetary-equivalent prizes, but for the first top prize. Similarly, the plurality of second monetary or monetary-equivalent prizes may be identical to the plurality of first monetary and monetary-equivalent prizes, but for the second top prize. The computer-implemented method may further comprise keeping the RTP percentage unchanged in both the provided opportunity to win one of the plurality of first monetary or monetary-equivalent prizes and in the provided opportunity to win one of the plurality of second monetary or monetary-equivalent prizes. A first probability that the first top prize will be randomly awarded may be set and a second probability that the second top prize will be awarded may be set such that the second probability is lower than the first probability. According to one embodiment, the computer-implemented method may further comprise increasing the RTP percentage in the provided opportunity to win one of the plurality of second monetary or monetary-equivalent prizes relative to the RTP in the provided opportunity to win one of the plurality of first monetary or monetary-equivalent prizes. The method may also comprise setting a first probability that the first top prize will be randomly awarded and also comprise setting a second probability that the second top prize will be awarded, and doing so in such a manner that the second probability is equal to the first probability. The opportunity to win one of the plurality of first monetary or monetary-equivalent prizes and/or the opportunity to win one of the plurality of second monetary or monetary-equivalent prizes may be presented as a pick'em forced choice. Alternatively, the opportunity to win one of the plurality of first monetary or monetary-equivalent prizes and/or the opportunity to win one of the plurality of second monetary or monetary-equivalent prizes may be presented as one or more spinning reels or wheels, for instance. Other implementations are possible. In one embodiment, the first and second stage complete states are defined by respective predetermined states of an in-game avatar in the game.

Figure 17:
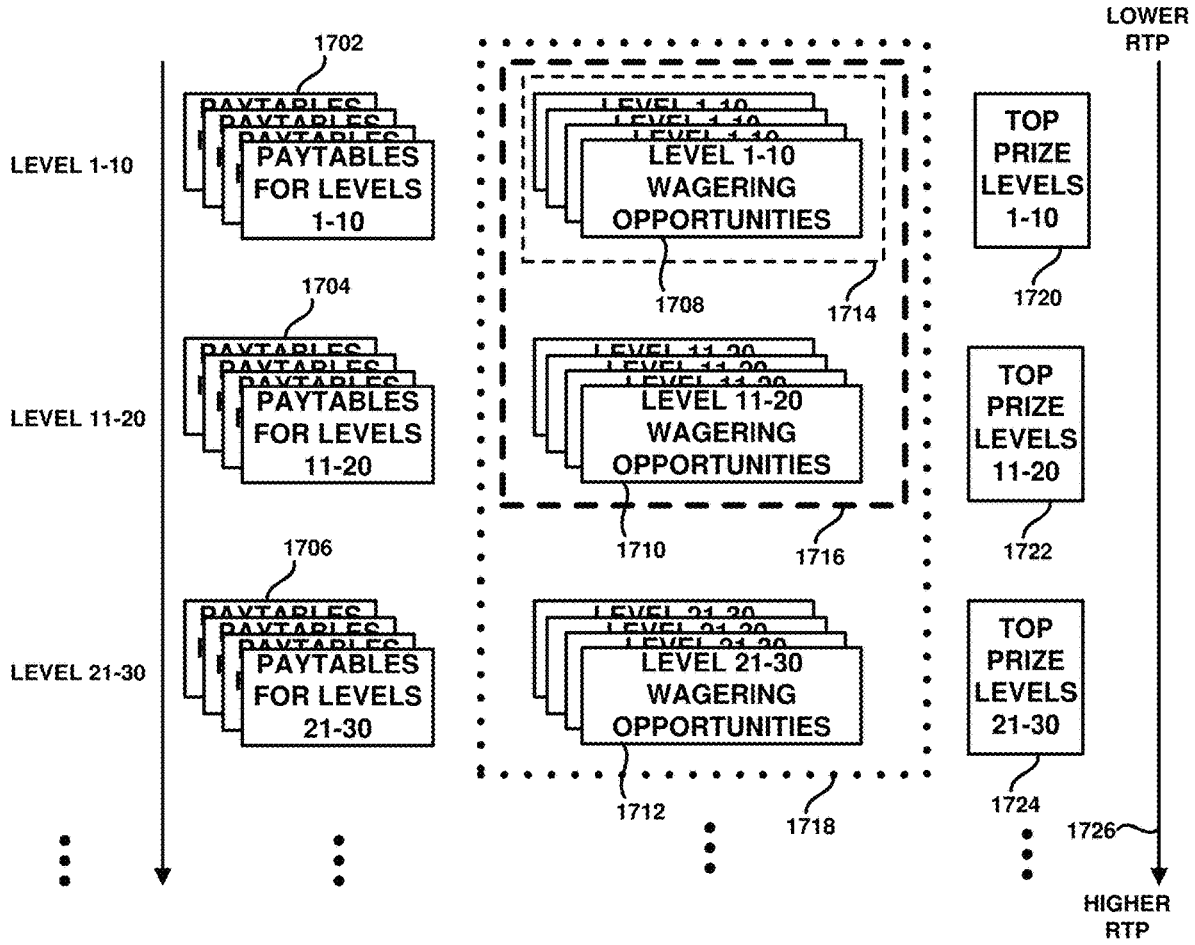
FIG. 17 is a diagram illustrating aspect of one embodiment.

FIG. 17 is a diagram showing aspects of one embodiment. As shown therein, increasing the top prize that is potentially winnable when a stage (or level as the terms are used interchangeably herein) complete state has been reached is not the only way to increase player engagement and potential winnings. As shown in FIG. 17, different paytables may be accessed and used to determine the reward due to the player having placed a wager, depending upon the level or stage of the game. Indeed, FIG. 17 shows that paytables 1702 may be accessed when the current game session is in any one of levels 1-10. Similarly, paytables 1704 may be used to determine the player rewards when the player is in levels 11-20 and paytables 1706 when the player is in levels 21 through 30. It is to be understood that the groupings of levels into groups 1-10, 11-20 and 21-30 is arbitrary and is shown in FIG. 17 solely for purposes of illustration. In other implementations, the groupings may be different or each or selected levels may have one or more paytables associated therewith. The paytables associated with one or more levels may or may not be available when the player has reached other levels. That is, the paytables 1702 and 1704 for levels 1-10 and 11-20, respectively, may or may not be accessible when the player has reached levels 21-30. In another implementation, only a single paytable per level or group of levels may be provided. In one embodiment, the paytables 1702, 1704 and 1706 may define progressively-higher RTPs, so as to reward the persistent or skilled players.

As also shown in FIG. 17, different wagering opportunities may be made available for player interaction, depending upon the current level or stage. As shown at 1708, Level 1-10 wagering opportunities may be available for player interaction in levels 1-10. Similarly, Level 11-20 wagering opportunities may be made available for player interaction in levels 11-20, but not in levels 1-10. Also, Level 21-30 wagering opportunities may be made available for player interaction in levels 21-30, but not in levels 11-20 or 1-10. These wagering opportunities may constitute the entirety of the wagering opportunities available in the respective levels, or may be provided in addition to other wagering opportunities. These wagering opportunities may, therefore, be "special guest stars" of their respective levels, as suggested at 1708. In another implementation, Level 1-10 wagering opportunities may also be available in addition to the Level 11-20 wagering opportunities in levels 11-20, as suggested at 1716. Lastly, Level 1-10 and Level 11-20 wagering opportunities may also be available in addition to the Level 21-30 wagering opportunities in levels 21-30, as suggested at 1718. These wagering opportunities 1708, 1710 and 1712 may operate as rewards to the player, may offer better odds than other wagering opportunities or may simply reward the player for each and every player interaction. The wagering opportunities 1708, 1710 and 1712 may operate to gradually increase the RTP 1726 as the player progresses through the respective levels or stages of the game. In one embodiment, the paytables 1702, 1704 and 1706 may be used in conjunction with wagering opportunities 1708, 1710 and 1712, or entirely separate therefrom. As described above, the top prizes for each level or groups of levels may be selected as desired. For example, the top prizes potentially winnable by the player in each level group may gradually increase, so as to further incentivize the player and enhance his or her enjoyment of the game. As those of skill in this art may appreciate, the knowledgeable game designer may wish to mix and match the level-specific paytables 1702, 1704, 1706 with the level-specific wagering opportunities 1708, 1710, 1712 and/or the level-specific top prizes 1720, 1722, 1724 for maximum effect in the game being developed. It is to be noted that increased playing time may also be awarded as a monetary-equivalent prize herein. Such increased time may enable further wagers or may simply enable further non-wager game play.

Figure 18A:
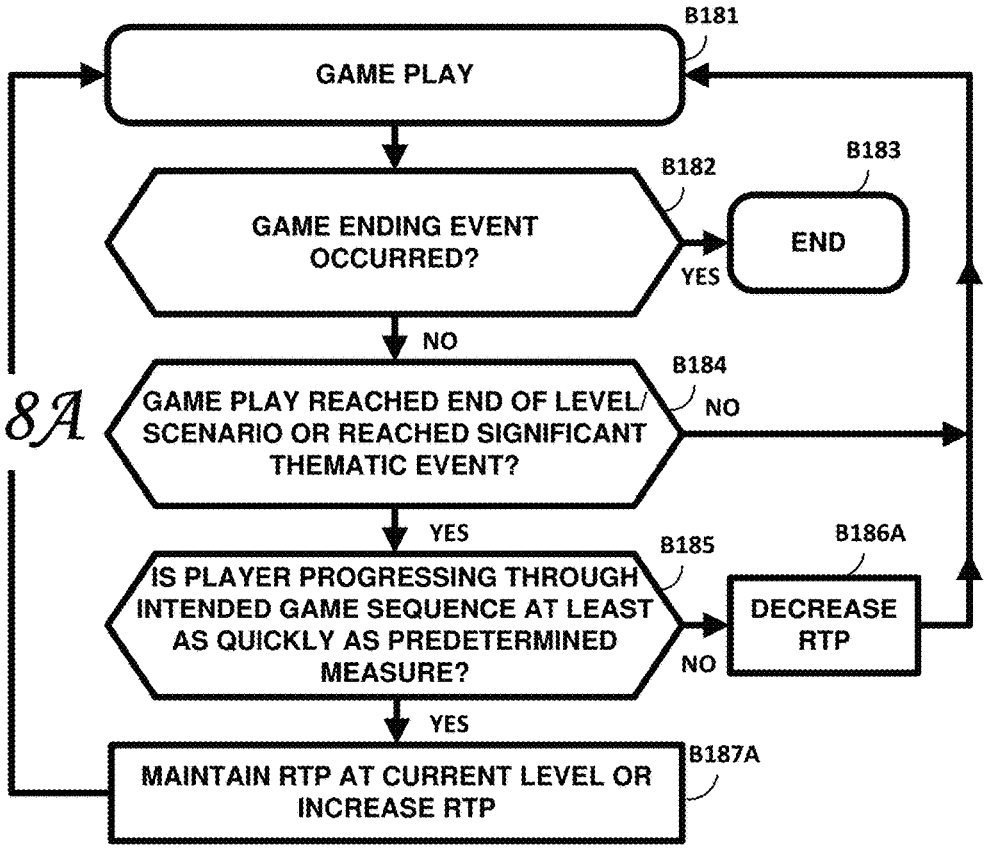
FIG. 18A is a flowchart illustrating aspects of a computer-implemented method according to an embodiment.

FIG. 18A is a flowchart illustrating aspects of a computer-implemented method according to an embodiment. As shown at B181, game play may be enabled, for example after the regulated gaming machine has accepted funds from the player and established a player account balance. At B182, it may be determined whether a game-ending event has occurred. Such game-ending event may include a cash out request initiated by the player. Alternatively, the play's account balance may have decreased to zero, or the game may have otherwise come to an end. If a game ending event has indeed occurred, the game may end as shown at B183. If no game ending event occurs (YES branch of B182), it may be determined whether game play has reached an end of a level, of a current scenario or reached a significant thematic event, as shown at B184. The level, of a current scenario or significant thematic event of block B184 may encompass most any division within the game that serves to delineate the one portion of the game from another. Such divisions may also include acts, as in a theater production, chapters as may be found in books and/or any other episode, part, sections, the accomplishment of a major goal within the game, subdivisions, level or stage and the like. In any event, hereunder, the terms listed immediately above are hereafter denoted by the terms "level" and "stage", it being understood that such terms are used interchangeably herein and that they encompass, within their scope, any and all of the aforementioned terms denoting divisions within the game.

If the end of the level or stage is determined not to have been reached, flow may revert back to B181 to continue game play. If, however, it is determined that game play has reached the end of a level, scenario or reached a predetermined significant thematic event (e.g., a boss monster has been defeated, a given area cleared, all targets hit, a race finished, etc. (YES branch of B184), it may be determined at B185 whether the player (and, by extension, game play) is progressing through the intended game sequence at least as quickly as a predetermined measure. For example, the game designer may have designed-in a predetermined or desired optimal game play pace—however measured. Such designed-in game play pace may ensure that the intended story unfolds in a manner that advances the game's narrative and that is likely to maximize the player's enjoyment of the game. For instance, each level of a multi-level or multi-stage game may have been designed to be completed or traversed by the player in about three minutes. However, the game may also provide the player with the freedom to advance through game play at his or her preferred pace. For example, the player may decide to linger on a preferred level for an extended period of time, repeating the same actions over and over. While permissible, remaining on a preferred game level or stage does not further the game's narrative and the player may tire of the game without discovering the exciting game play in available in later levels. For example, the player may linger on a side game or a mini game within a given stage, steadily, but slowly, loosing or accumulating credits. This is one way in which the player may fail to progress through the intended game sequence as quickly as the game designer had anticipated.

Another way is for a player to repeatedly play the same level over and over. The player may enjoy a given level and may have become skilled at accomplishing the tasks required by that level. While not impermissible in many games, such perseveration likewise does not advance the game's narrative and the player may become bored or stuck, never experiencing the remainder of the game. One embodiment, therefore, calls for programmatically changing the RTP to encourage forward-directed game play. Such programmatic control and/or changing of the RTP may take several forms, including maintaining the RTP unchanged, increasing the RTP to encourage the desired player behavior, decreasing the RTP to discourage unwanted player behavior or doing both: increasing the RTP when game play progresses satisfactorily as well as decreasing the RTP when game play is determined to not have progressed satisfactorily. In one embodiment, the RTP may be selectively maintained unchanged or increased when game play progresses as intended and decreased when game play is not progressing, to encourage the player to move forward and explore later or other game play scenarios, levels, stages or story lines.

Returning now to FIG. 18A, after a determination is made that the player is not progressing though the intended game play sequence at least as quickly as a predetermined measure (NO branch of B185), the RTP of the game may at least temporarily be decreased (or in one embodiment, maintained unchanged), as shown at B186A, whereupon the flow may revert to B181, to enable continued game play. Such a predetermined measure may take the form of a time limit, a count of player interactions or most any other measurable value. This RTP "hit" (decrease in RTP) may be on the order of a few tenths of a percent or may be larger or smaller. The reduced RTP may be in effect for a predetermined or a variable amount of time. For example, the reduced RTP may be in effect until game play is observed to move forward through the game's narrative or intended sequence, whereupon the RTP may be increased. A notice that the RTP has been changed may be displayed for the player, along with a suggestion to move forward through the game or an explanation why the RTP changed. A countdown clock or other graphic device may be displayed, indicating the time remaining during which the reduced RTP may be in effect to, in effect, nudge the player into the desired behavior.

In one embodiment, the reduction in the RTP may be paired with a special bonus, enabling the player to make up any losses he or she may have incurred, provided that the game play resumes along a forward path. One embodiment, therefore, aims not to penalize the player, but to encourage the player to progress through the game. In another embodiment, when the RTP is reduced, the game may be reconfigured to change the wagering opportunities offered to the player. For instance, a greater number of wagering opportunities may be offered for interaction by the player, such that the player has the opportunity to make a greater number of wagers, albeit at a lower aggregate RTP. In yet another embodiment, the game may indulge the player who wishes to persevere at a given level, task, or story line, even at a lower RTP, and thereafter gradually evolve the provided game environment and game play to progressively ease the player into other aspects, scenarios, levels, narratives of the game.

If, however, game play is indeed progressing though the intended game play sequence at least as quickly as a predetermined measure (YES branch of B185), the RTP of the game may at least temporarily be increased to reward this desired player behavior, as shown at B187A. That the RTP has been at least temporarily been increased may be displayed to great fanfare on the regulated gaming device's display, to reinforce the behavior. Alternatively, as also shown at B187A, the RTP may be maintained at the current level. In any event, whether the RTP is maintained as is, increased or decreased, game play may then continue as shown at B181, at least until a game ending even occurs, as indicated at B182.

Figure 18B:
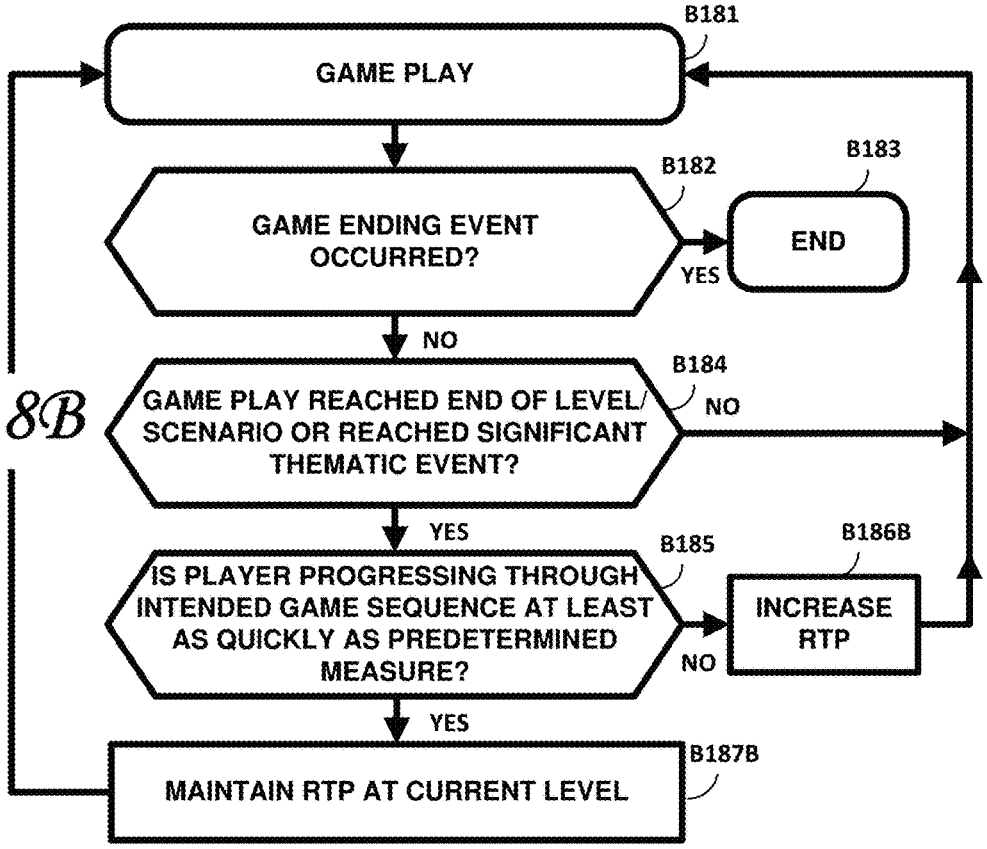
FIG. 18B is a flowchart illustrating aspects of a computer-implemented method according to an embodiment.

FIG. 18B is a flowchart illustrating aspects of a computer-implemented method according to an embodiment. FIG. 18B is identical to FIG. 18A, but for blocks B186A and B187A. FIG. 18B is predicated upon a different approach to influencing the behavior of a player. Rather than penalizing the player for not progressing through the game at an expected pace, the game's analytics may determine that the player, rather than persevering at a favorite level, is actually struggling to make satisfactory progress through the game's narrative. Indeed, the player may be new to the game, having a bad day, or simply not performing at his or her peak. Decreasing the RTP at this stage may hurt player retention, at he or she may lose confidence in the his or her ability to play the game, or make a satisfactory return (in terms of sheer entertainment value and/or winnings) on his or her gaming budget. Therefore, if the game determines that boosting the RTP, at least temporarily, may help keep the player in his or her seat, the RTP may actually be increased at B186B, and a notification of the same may be displayed on the regulated gaming machine's display. Alternatively, a bonus may be made available. For example, a message such as "Don't give up! To help you, every wager for the next three minutes will return 10% more!", or such as "Hang in There! Here's a Bonus of $5 to help you master this tricky area". Moreover, rather than increasing the RTP or bonus, as shown at B187A in FIG. 18A, block B187B may call for maintaining the RTP or bonus at current levels.

Figure 19:
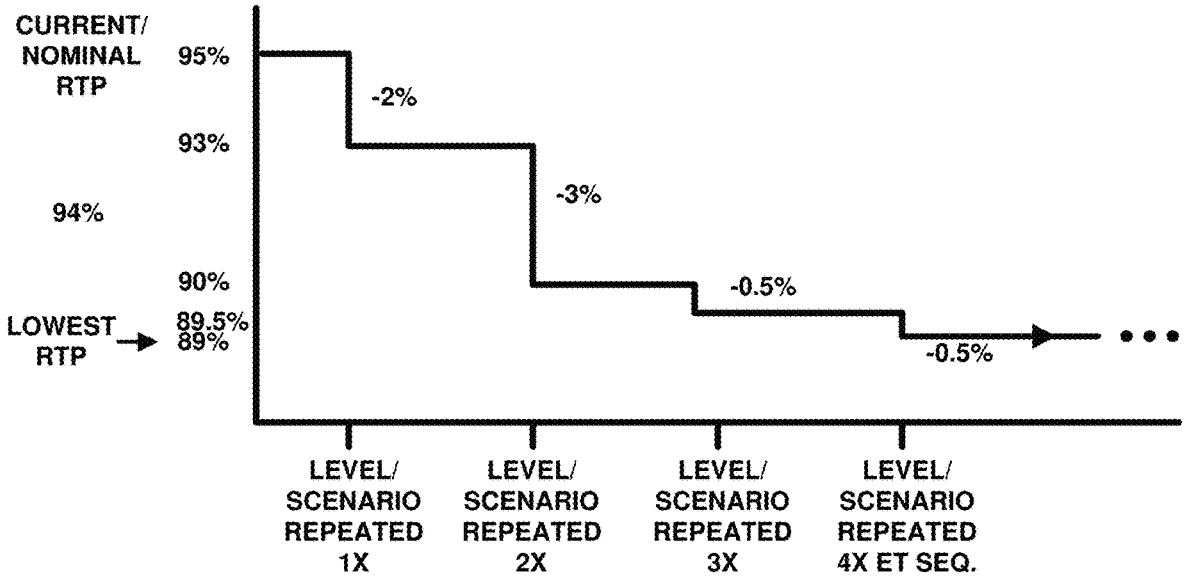
FIG. 19 is a chart illustrating aspects of a computer-implemented method according to an embodiment.

FIG. 19 is a chart illustrating aspects of a computer-implemented method according to an embodiment. According to one embodiment, the RTP may be maintained unchanged in certain circumstances. In others, the RTP may be decreased (as shown at B186A in FIG. 18A) in a stepwise manner, according to a predetermined schedule. As shown therein, the game may have a nominal RTP of, say, 95%. According to one embodiment, the RTP may at least temporarily decreased (or, in one embodiment, maintained unchanged), increased each time a given level, scenario or story line is repeated within a gaming session. Such decreases may be equal in magnitude or the stepwise decreases may be tuned according to the some schedule. As shown in FIG. 19, the nominal RTP is 95%, which may be maintained as long as game play progresses satisfactorily. If, however, the player repeats the same level or scenario one time, the RTP may decrease by, say, 2%. Upon the next repeat of the same level, stage, scenario or story line, the RTP may be decreased 3%, to 90%. A third repeat, as shown in FIG. 19, may decrease the RTP by 0.5%, as may the fourth repeat, bringing the RTP at least temporarily down to 89%, which may be constitute the lowest RTP allowed by gaming regulations or the lowest RTP the game designers wish to impose upon the game. As shown in FIG. 19, in this example, subsequent repeats may not be penalized (at least in terms of RTP), as the player clearly does not want to progress through the game and appears quite content to remain at this level/stage or to repeat the current scenario or story line. In one embodiment, the successive decreases may be equal, may be unequal or may be variable and dependent upon some other in-game or external factors. In other words, changes to the RTP may depend upon other factors, in addition to the progression of game play discussed herein.

Figure 20:
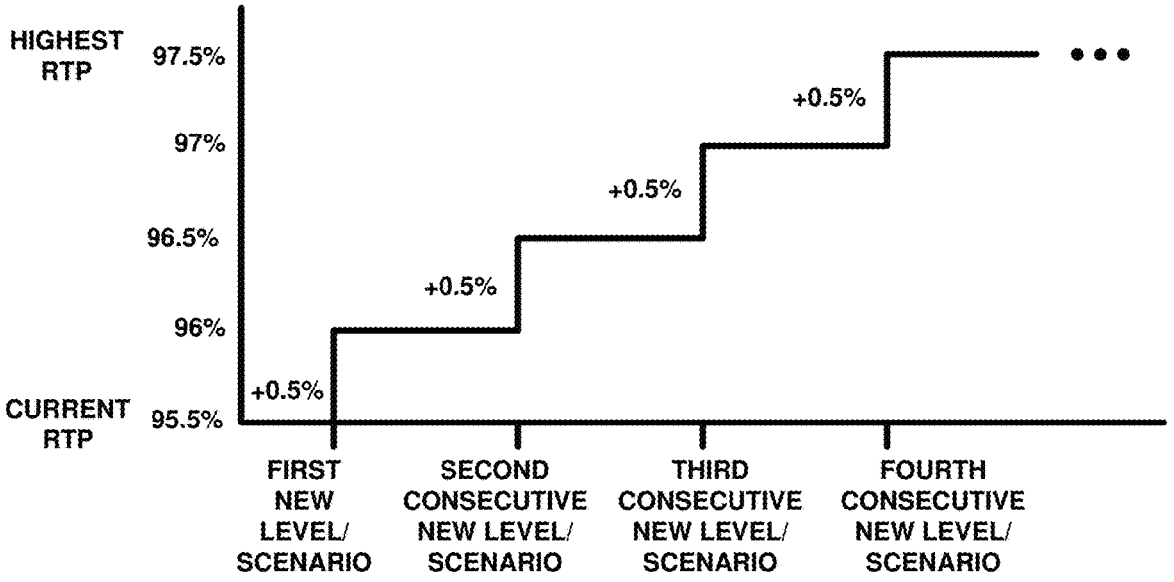
FIG. 20 is a chart illustrating aspects of a computer-implemented method according to an embodiment.

FIG. 20 is a chart illustrating aspects of a computer-implemented method according to an embodiment. As shown therein, the RTP may be selectively increased to reward desired player behavior and game play that progresses as intended. For example, the RTP may progress, in a step-wise manner, from a current level of, say, 95.5% to a highest RTP of 97.5%, as game play progresses through consecutive new levels, stages, scenarios, story lines and the like. As with the RTP decreases discussed relative to FIG. 19, the RTP may increase in equal steps, or the increases may be unequal, and based upon some in-game factor or factor(s) external thereto. At any time, the RTP may be maintained unchanged for the duration of the game or for any shorter period of time.

According to one embodiment, the increases and decreases may be quite small; on the order of, for example, a few tenths of a percent. For particularly significant achievements, such as reaching a final level or defeating a particularly difficult foe, the RTP boost may be more significant. According to one embodiment, the programmatic changes in RTP may be configured to both increase and decrease the RTP within a single game session. For example, game play may have progressed such that a third consecutive new level or scenario has been reached and the RTP increased to 97%. If, thereafter, game play lingers on this level or stage, and the player causes the game play to repeat that level or stage three times, the RTP may decrease 2% the first time the level or stage is repeated, another 3% the second time the level or stage is repeated and 0.5% for the third iteration of this level or stage. Therefore, the RTP would be reduced from 97% to 91.5% for this thrice-repeated level or stage. It may also be envisaged that the RTP varies quasi-continuously during game play, to reward or discourage certain player behaviors, or game play patterns. Indeed, the RTP may be varied more frequently than at such levels or stages and may smoothly vary intra-stage based upon, for example, some game play attribute such as speed of interaction with wagering opportunities.

In another embodiment, changes in RTP may trigger bonusses that may be selectively made available to the player, giving him or her the opportunity to "recoup" any losses he or she may have incurred through the progressive reductions in RTP. Again, the goal may not be to penalize the player but to encourage level exploration and forward movement of the game. In yet another embodiment, the RTP may be changed up or down for reasons unrelated to forward movement or lack thereof through the game narrative. For example, while the RTP may be successively be adjusted up or down depending upon the forward or retrograde flow of the game play, such may also be adjusted for any other reason, whether in-game or external to the game. For example, the time of day may be considered in adjusting the RTP. For example, to encourage off-peak game play, the RTP may be set initially higher between 10:00 am and 3:00 pm, even as the RTP may be increased or decreased (or maintained unchanged) due to the forward flow or lack thereof of game play, as detailed above. Other mechanisms for adjusting the RTP to encourage desired behavior may be put in place, in addition to or, at time, in place of the above-detailed mechanisms.

Figure 21:
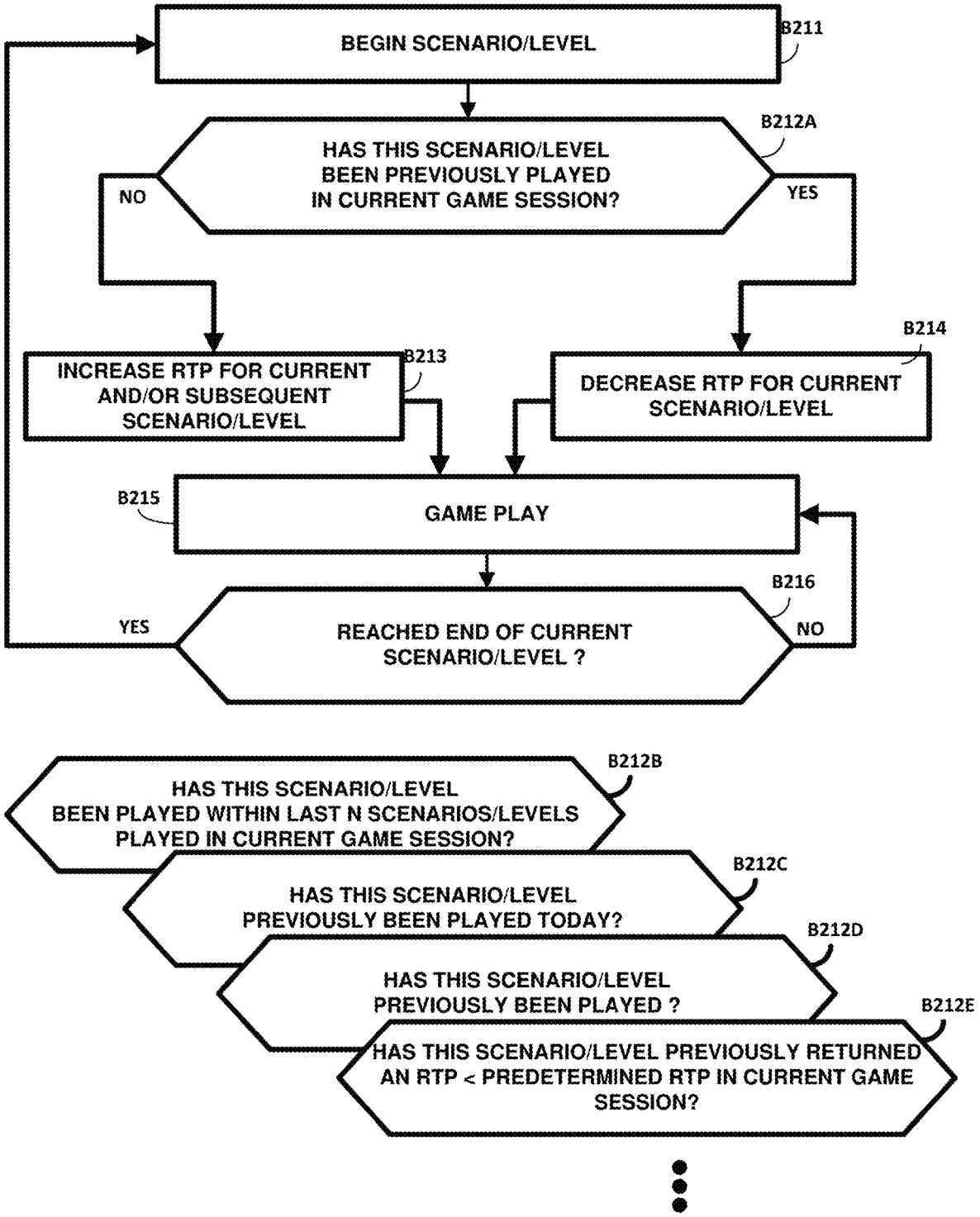
FIG. 21 is a flowchart illustrating aspects of a computer-implemented method according to an embodiment.

FIG. 21 is a flowchart illustrating aspects of a computer-implemented method according to an embodiment. As shown therein B211 calls for game play at a given scenario, level, stage, act, chapter and the like. At B212A, a determination may be made whether this scenario/level has been previously played in the current game session. If the answer is yes (YES branch of B212A), the RTP may be decreased (or, in one embodiment, maintained unchanged), at least for the current scenario/level, as shown at B214. If however, it is determined that this scenario/level has not been previously been played in the current game session (NO branch of B212A), the RTP may be increased at least for the current scenario/level, and/or may be increased for subsequent scenarios/levels, as shown at B213. In another embodiment, B213 may call for maintaining the RTP at its current level. Whether the RTP is maintained the same, increased or decreased, the flow of the present computer-implemented method proceeds to B215 and game play continues. At B216, it may be determined whether game play has reached the end of the current scenario/level. If not (NO branch of B216), flow reverts to B215 to enable game play to continue. If, however, game play has reached the end of the current scenario/level (YES branch of B216), the flow reverts to B211, to begin game play of the new scenario/level.

FIG. 21 also shows a number of alternative embodiments in which block B212A is replaced by one of the determinations shown at B212B, B212C, B212D or B212E. Other alternatives are possible, as those of skill in this art may appreciate. As shown at B212B, instead of a determination whether the current scenario/level has been previously played in the current game session, it may be determined whether the current scenario/level has been played within last N scenarios/levels played within the current game session, as shown at B212B. When integer N is set at 3 for example, the player may occasionally repeat a favorite scenario/stage without triggering a reduction in the RTP. Indeed, assuming the player has consecutively played levels 3, 4, 5 and 6, the player may return to his or her happy place at level 3, for example, without triggering a reduction in RTP. In this case, B213 may maintain the RTP at its current level. Other alternatives are possible. For example, alternative block B212C determines whether this scenario/level has previously been played by the player today. This causes the RTP to decrease (or, in one embodiment, maintained constant, unchanged), even across gaming sessions, if a player repeats a given scenario/level, stage, story line and the like in a same day. For example, the player may have played early in the afternoon, left for a drink and a snack and returned later to start another gaming session. If it is determined that the player has previously played a given level, the RTP may be decreased (or, in one embodiment, maintained unchanged). B212D is even stricter, making a determination if the player has ever played this scenario/level. Other possibilities include, for example, comparing an RTP previously in force for a given scenario/level with a predetermined RTP and making the decision to increase, maintain or decrease the RTP for the current or subsequent scenario/level based upon the result of the comparison, as shown at B212E. Many other alternatives are possible.

Figure 22:
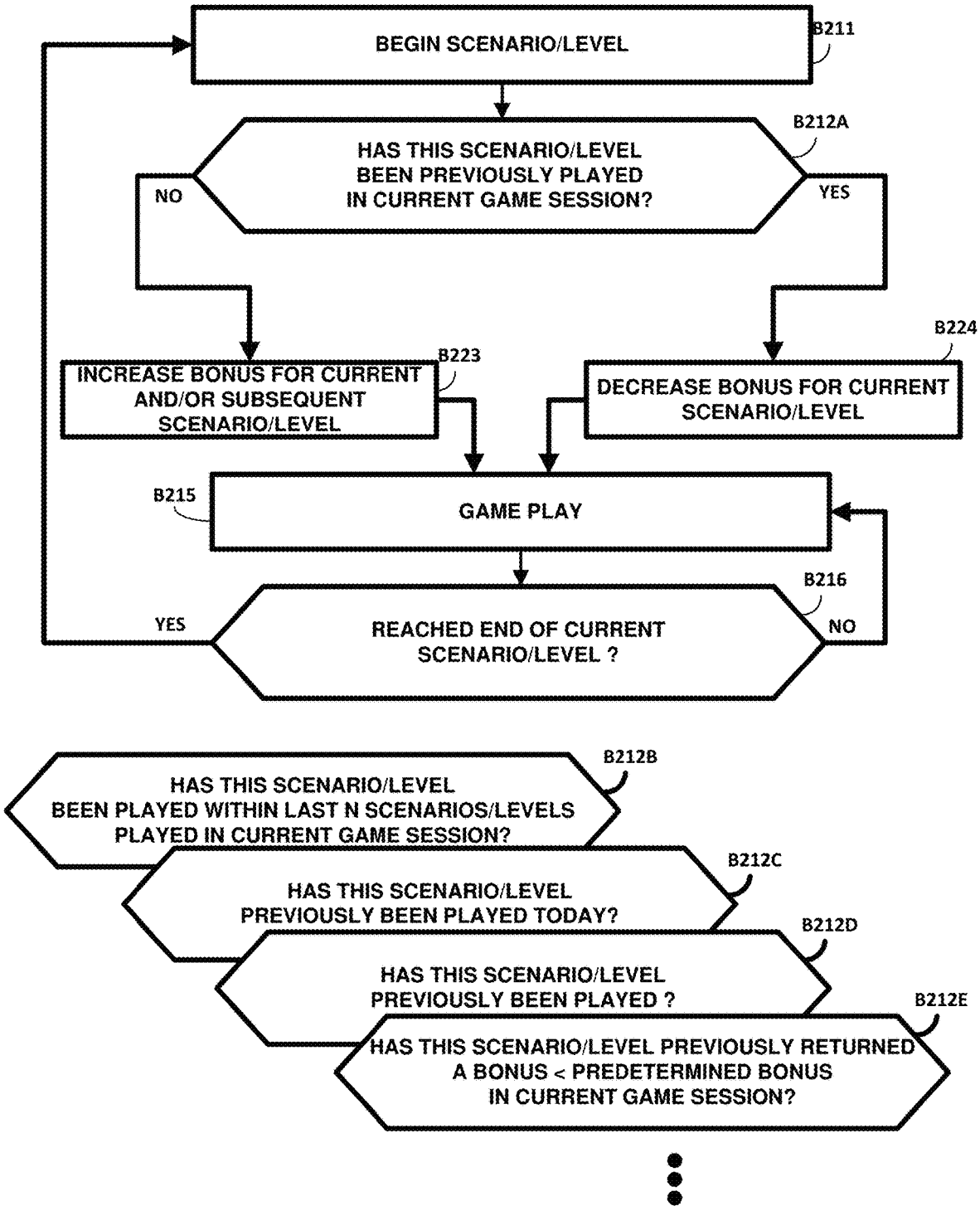
FIG. 22 is a flowchart illustrating aspects of a computer-implemented method according to an embodiment.

FIG. 22 is a flowchart illustrating aspects of a computer-implemented method according to an embodiment. FIG. 22 is identical to FIG. 21 but for blocks B223 and B224. Indeed, instead of changing the RTP within a scenario or level and keeping all else identical, a bonussing system may be implemented to similarly influence player behavior. FIG. 22 assumes the presence of a bonus that the player may earn in one or more the game's scenarios/levels. If block B212A determines that the current scenario/level has not been previously played in the current gaming session, block B223 may be executed, by increasing the bonus for the current and/or subsequent scenarios/levels. Alternatively, block B223 may be configured to maintain unchanged the currently-available bonus. If, however, block B212A determines that the current scenario/level has, in fact, been previously played in the current gaming session, block B224 may be executed, by decreasing or maintaining unchanged the bonus available for the current and/or subsequent scenarios/levels. In this manner, the changes in RTP discussed at least relative to FIGS. 18-22 may be replaced and/or accompanied, according to embodiments, by corresponding changes in a bonus or bonusses.

One embodiment, therefore, is a computer-implemented method, comprising providing a wager-based electronic gaming device (EGD), the EGD comprising at least one processor, memory, a display, an input interface and a money acceptor, the at least one processor being configured to execute computer-readable instructions stored in the memory for at least: accepting money from a player via the money acceptor and establishing an account balance using the received money; displaying, on the display, a game environment configured to enable the player to participate, via the input interface, in a gaming session of a wager-based game comprising a plurality of stages; enabling, for the gaming session, game play and wagers in a current stage of the plurality of stages of the wager-based game; determining that game play in the current stage has reached a current stage complete state in which all requirements necessary for transitioning game play from the current stage to a next or other stage of the plurality of stages have been met and determining whether the game play transitions from the current stage to the next or other stage or remains at or returns to the current stage. When game play transitions from the current stage to the next or other stage of the plurality of stages, the computer-implemented method may call for increasing a Return-To-Player (RTP) of the wager-based game; and when game play remains at or returns to the current stage after the current stage complete state is reached, the computer-implemented method may call for decreasing or maintaining unchanged the RTP of the wager-based game.

According to further embodiments, the computer-implemented method may determine the number of times game play remains or returns to the current stage and may decrease or maintain unchanged the RTP of the wager-based game in proportion to the number of times game play remains or returns to the current stage. The RTP may increase each time game play transitions to a next-consecutive stage of the plurality of stages.

Another embodiment is a computer-implemented method, comprising providing a wager-based electronic gaming device (EGD), the EGD comprising at least one processor, memory, a display, an input interface and a money acceptor, the processor(s) being configured to execute computer-readable instructions stored in the memory. These computer-readable instructions may be configured for, at least, accepting money from a player via the money acceptor and establishing an account balance using the received money; displaying, on the display, a game environment configured to enable the player to participate, via the input interface, in a gaming session of a wager-based game comprising a plurality of stages; enabling, for the gaming session, game play and wagers in a current stage of the plurality of stages of the wager-based game and determining whether a current stage of the plurality of stages has been previously played.

When the current stage is determined to have been previously played, the Return-To-Player (RTP) of the wager-based game for the current stage may be decreased or maintained unchanged and when the current stage is determined to not have been previously played, the RTP of the wager-based game may be increased for at least one of the current stage and a next-consecutive stage of the plurality of stages.

According to further embodiments, the determining step or functionality may determine whether the current stage of the plurality of stages has been previously played during the gaming session, and the RTP may be decreased or maintained unchanged for the current stage when the current stage is determined to have been previously played during the gaming session, and the RTP may be increased for the current stage when the current stage is determined not to have been previously played during the gaming session. In another embodiment, determining determines whether the current stage of the plurality of stages has been previously played within a selectable number N of stages played during the gaming session, and the RTP may be decreased or maintained unchanged for the current stage when the current stage is determined to have been previously played within the selectable number N of stages played during the gaming session, and the RTP may be increased for the current stage when the current stage is determined not to have been previously played within the selectable number N of stages played during the gaming session. In yet another embodiment, determining may determine whether the current stage of the plurality of stages has been previously played by the player within a same day (or other amount of time), such that the RTP is decreased or maintained unchanged for the current stage when the current stage is determined to have been previously played by the player within the same day, and such that the RTP is increased for the current stage when the current stage is determined not to have been previously played by the player during the same day. Determining may alternatively determine whether the current stage of the plurality of stages has an RTP that is less than a predetermined RTP, such that the RTP is increased for the current stage when the current stage is determined to have an RTP that is less than the predetermined RTP, and such that the RTP is maintained unchanged for the current stage when the current stage is determined to not have an RTP that is less than the predetermined RTP.

Another embodiment is an electronic, wager-based gaming device, comprising a memory; at least one processor; a display; an input interface; and a plurality of processes spawned by the processor, the plurality of processes comprising processing logic stored in the memory and configured to: accept money from a player via the input interface and establish an account balance using the received money; display, on the display, a game environment configured to enable the player to participate, via the input interface, in a gaming session of a wager-based game comprising a plurality of stages; enable, for the gaming session, game play and wagers in a current stage of the plurality of stages; determine that game play in the current stage has reached a current stage complete state in which all requirements necessary for transitioning game play from the current stage to a next or other stage of the plurality of stages have been met; determine whether the game play transitions from the current stage to the next or other stage or remains at or returns to the current stage; when game play transitions from the current stage to the next or other stage of the plurality of stages, increase at least one of a Return-To-Player (RTP) and a bonus of the wager-based game; and when game play remains at or returns to the current stage after the current stage complete state is reached, decrease or maintain unchanged at least one of the RTP and the bonus of the wager-based game.

The electronic, wager-based gaming device may further comprise comprising processing logic to determine a number of times game play remains or returns to the current stage; and to decrease the RTP of the wager-based game in proportion to the number of times game play remains or returns to the current stage. The electronic, wager-based gaming device may further comprise processing logic to increase the RTP each time game play transitions to a next-consecutive stage of the plurality of stages.

A still further embodiment is an electronic, wager-based gaming device, comprising: a memory; at least one processor; a display; an input interface; and a plurality of processes spawned by the processor, the plurality of processes comprising processing logic stored in the memory and configured to: accept money from a player via the input interface and establish an account balance using the received money; display, on the display, a game environment configured to enable the player to participate, via the input interface, in a gaming session of a wager-based game comprising a plurality of stages; enable, for the gaming session, game play and wagers in a current stage of the plurality of stages; determine whether a current stage of the plurality of stages has been previously played; when the current stage is determined to have been previously played, decrease or maintain unchanged a Return-To-Player (RTP) of the wager-based game for the current stage; and when the current stage is determined to not have been previously played, increase the RTP of the wager-based game for at least one of the current stage and a next-consecutive stage of the plurality of stages.

The processing logic for determining may be configured to determine whether the current stage of the plurality of stages has been previously played during the gaming session, and the processing logic may be further configured to decrease or maintain unchanged the RTP for the current stage when the current stage is determined to have been previously played during the gaming session, and further configured to increase the RTP for the current stage when the current stage is determined not to have been previously played during the gaming session. The processing logic for determining may be further configured to determine whether the current stage of the plurality of stages has been previously played within a selectable number N of stages played during the gaming session. When the current stage is determined to have been previously played within the selectable number N of stages played during the gaming session, the processing logic may be configured to decrease or maintain unchanged the RTP for the current stage and when the current stage is determined not to have been previously played within the selectable number N of stages played during the gaming session, the processing logic may be configured to increase the RTP for the current stage. In one embodiment, the processing logic for determining may be further configured to determine whether the current stage of the plurality of stages has been previously played by the player within a same day. In such a case, when the current stage is determined to have been previously played by the player within the same day (or other amount of time), the processing logic may decrease or maintain unchanged the RTP for the current stage, and when the current stage is determined not to have been previously played by the player during the same day, the processing logic may increase the RTP for the current stage. The processing logic for determining may be further configured to determine whether the current stage of the plurality of stages has an RTP that is less than a predetermined RTP. When the current stage is determined to have an RTP that is less than the predetermined RTP, the processing logic may increase the RTP for the current stage and when the current stage is determined to not have an RTP that is less than the predetermined RTP, the processing logic may maintain the RTP unchanged for the current stage.

In yet another embodiment, a computer-implemented method may comprise providing a wager-based electronic gaming device (EGD), the EGD comprising at least one processor, memory, a display, an input interface and a money acceptor, the at least one processor being configured to execute computer-readable instructions stored in the memory for at least: accepting money from a player via the money acceptor and establishing an account balance using the received money; displaying, on the display, a game environment configured to enable the player to participate, via the input interface, in a gaming session of a wager-based game comprising a plurality of stages; enabling, for the gaming session, game play and wagers in a current stage of the plurality of stages of the wager-based game; determining game play is progressing through the plurality of the stages of the wager-based game at a pace that is at least as quick as a predetermined pace; when the game play is determined to be progressing through the plurality of stages at a pace that is less quick than the predetermined pace, changing at least one of a Return-To-Player (RTP) of the wager-based game and a bonus for the current stage; and when the game play is determined to be progressing through the plurality of stages at a pace that is quicker than the predetermined pace, maintaining unchanged or increasing at least one of the Return-To-Player (RTP) of the wager-based game and the bonus for the current stage.

Changing at least one of the RTP and the bonus for the current stage may, in one embodiment, comprises increasing the RTP and/or the bonus for the current stage. In another embodiment, changing the RTP and/or the bonus for the current stage may comprise decreasing the RTP and/or the bonus for the current stage.

Figure 23:
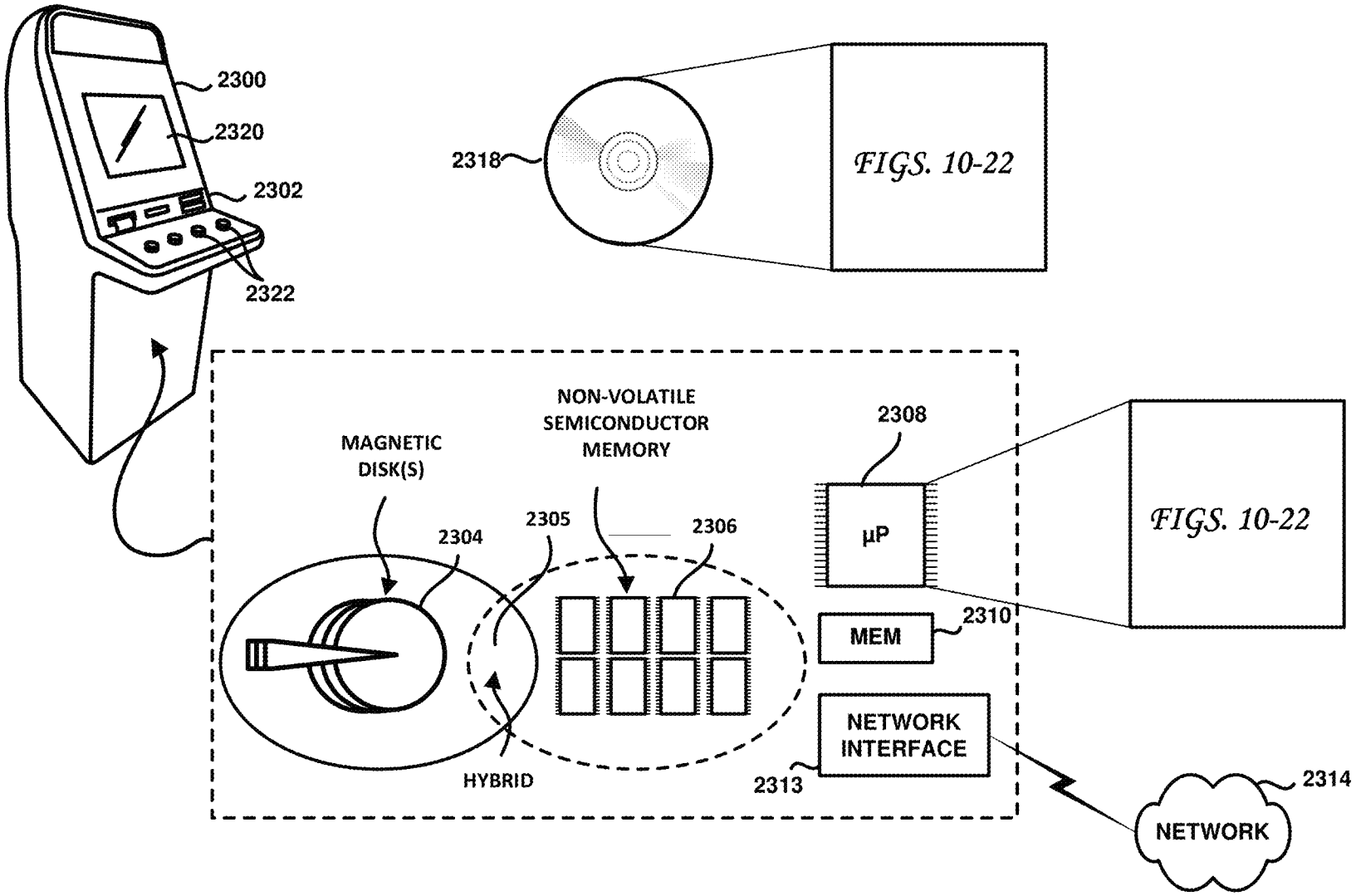
FIG. 23 shows a wager-based regulated gaming machine configured according to embodiments.

Another embodiment is a tangible, non-transitory computer-readable medium as shown at 2318 in FIG. 23. This tangible, non-transitory computer-readable medium may have data stored thereon representing sequences of instructions which, when executed by a regulated gaming computing device, cause the regulated gaming to carry out the above shown and described computer-implemented methods. Other examples of such tangible, non-transitory computer-readable media are shown at references 2304, 2305, 2306 and 2310 in FIG. 23 and elsewhere in the figures.

In greater detail, FIG. 23 shows a wager-based regulated gaming machine configured according to embodiments and configured to execute the computer-implemented methods shown and described herein. According to one embodiment, an electronic, wager-based gaming device 2302 may comprise a memory 2304, 2305, 2306, 2310, at least one processor 2308, a display 2320 and a user interface 2322. A plurality of processes may be spawned by the processor, which plurality of processes may comprise processing logic to carry out the functionality shown and described at least relative to FIGS. 10-22. FIG. 23 also shows exemplary tangible, non-transitory computer-readable media 2318, 2304, 2305 or 2306 having data stored thereon representing sequences of instructions which, when executed by the regulated gaming computing device, cause the regulated gaming computing device to determine rewards due to a player playing a wager-based game according to embodiments in one of the manners described herein.

Discussing now FIG. 23 in greater detail, reference number 2302 is a regulated gaming machine, also referenced herein as an electronic gaming device (EGD) and electronic gaming machine (EGM). The regulated gaming machine 2302 may comprise direct access data storage devices such as magnetic disks 2304, non-volatile semiconductor memories (EEPROM, Flash, etc.) 2306, a hybrid data storage device 2305 comprising both magnetic disks 2304 and non-volatile semiconductor memories, one or more microprocessors 2308 and volatile memory 2310. The regulated gaming machine 2302 may also comprise a network interface 2313, configured to communicate over network 2314 with remote servers, storage services and the like. References 2304, 2305 and 2306 are examples of tangible, non-transitory computer-readable media having data stored thereon representing sequences of instructions or processing logic which, when executed by a regulated gaming computing device, cause the regulated gaming computing device to provide wager-based games enable the present computer-implemented methods described and shown herein, particularly at FIGS. 10-22. Some of these instructions may be stored locally in the gaming machine 2302, while others of these instructions may be stored (and/or executed) remotely and communicated to the gaming machine 2302 over the network 2314. In other embodiments, all these instructions may be stored locally in the gaming machine 2302, while in still other embodiments, all of these instructions are stored and executed remotely, based on payer interactions at the gaming machine 2302, and the results communicated to the gaming machine 2302. In another embodiment, the instructions may be stored on another form of a tangible, non-transitory computer readable medium, such as shown at 2318. For example, reference 2318 may be implemented as an optical disk, which may constitute a suitable data carrier to load the instructions stored thereon onto the gaming machine 2302, thereby re-configuring the gaming machine to one or more of the embodiments described and shown herein. In other implementations, reference 2318 may be embodied as an encrypted persistent memory such as a Flash drive. Other implementations are possible.

In the foregoing description, numerous specific details are set forth in order to provide a thorough understanding of one or more aspects and/or features of the exemplary embodiments. It will be apparent to one skilled in the art, however, that one or more aspects and/or features described herein may be omitted in favor of others or omitted all together. Herein, each described and/or shown important feature, structure or functionality can be isolated from the others. Thus, individual aspects, features, structures described in relation to one embodiment may be used in, added to or substituted in in relation to another embodiment. In some instances, the description of well-known process steps and/or structures are omitted for clarity or for the sake of brevity.

Herein, devices or processes that are described as being in communication with each other need not be in continuous communication with each other, unless expressly specified otherwise. In addition, devices or processes that are disclosed to be in communication with one another may communicate directly or indirectly through one or more intermediaries.

Further, although constituent steps of methods have been described in a sequential order, such methods may be configured to work in alternate orders. In other words, any sequence or order of steps that may be described herein does not, in and of itself, indicate a requirement that the steps be performed in that order. The steps of described processes may be performed in an order that differs from the order described herein. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred over other processes.

When a single device or article is described, it will be readily apparent that more than one device/article (e.g., whether or not they cooperate) may be used in place of a single device/article. Similarly, where more than one device or article is described (e.g., whether or not they cooperate), it will be readily apparent that a single device/article may be used in place of the more than one device or article. The functionality and/or the features of a device may be alternatively embodied by one or more other devices that are not explicitly described as having such functionality/features.

Lastly, while certain embodiments of the disclosure have been described, these embodiments have been presented by way of example only and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all the features and advantages set forth herein, are also within the scope of this disclosure. Accordingly, the scope of the present disclosure is intended to be defined only by reference to the appended claims.

The invention claimed is:

1. A computer-implemented method, comprising:

providing a wager-based electronic gaming device (EGD), the EGD comprising at least one processor, memory, a display, an input interface, the at least one processor being configured to execute computer-readable instructions stored in the memory for at least:

accepting money from a player via the input interface and establishing an account balance using the received money;

displaying, on the display, a game environment configured to enable the player to participate, via the input interface, in a gaming session of a wager-based game comprising a plurality of stages;

enabling, for the gaming session, game play and wagers in a current stage of the plurality of stages of the wager-based game;

determining whether a current stage of the plurality of stages has been previously played;

when the current stage is determined to have been previously played, decreasing a Return-To-Player (RTP) of the wager-based game for the current stage; and when the current stage is determined to not have been previously played, increasing the RTP of the wager-based game for at least one of the current stage and a next-consecutive stage of the plurality of stages.

2. The computer-implemented method of claim 1, wherein determining determines whether the current stage of the plurality of stages has been previously played within a selectable number N of stages played during the gaming session, wherein the RTP is decreased for the current stage when the current stage is determined to have been previously played within the selectable number N of stages played during the gaming session, and wherein the RTP is increased for the current stage when the current stage is determined not to have been previously played within the selectable number N of stages played during the gaming session.

3. The computer-implemented method of claim 1, wherein determining determines whether the current stage of the plurality of stages has been previously played by the player within a same day, wherein the RTP is decreased for the current stage when the current stage is determined to have been previously played by the player within the same day, and wherein the RTP is increased for the current stage when the current stage is determined not to have been previously played by the player during the same day.

4. The computer-implemented method of claim 1, wherein determining determines whether the current stage of the plurality of stages has an RTP that is less than a predetermined RTP, wherein the RTP is increased for the current stage when the current stage is determined to have an RTP that is less than the predetermined

RTP.

5. An electronic, wager-based gaming device, comprising:

a memory;

at least one processor;

a display;

an input interface; and a plurality of processes spawned by the processor, the plurality of processes comprising processing logic stored in the memory and configured to:

accept money from a player via the input interface and establish an account balance using the received money;

display, on the display, a game environment configured to enable the player to participate, via the input interface, in a gaming session of a wager-based game comprising a plurality of stages;

enable, for the gaming session, game play and wagers in a current stage of the plurality of stages;

determine whether a current stage of the plurality of stages has been previously played;

when the current stage is determined to have been previously played, decrease a Return-To-Player (RTP) of the wager-based game for the current stage; and when the current stage is determined to not have been previously played, increase the RTP of the wager-based game for at least one of the current stage and a next-consecutive stage of the plurality of stages.

6. The electronic, wager-based gaming device of claim 5, wherein the processing logic for determining is further configured to determine whether the current stage of the plurality of stages has been previously played within a selectable number N of stages played during the gaming session, and when the current stage is determined to have been previously played within the selectable number N of stages played during the gaming session, the processing logic is configured to decrease the RTP for the current stage, and when the current stage is determined not to have been previously played within the selectable number N of stages played during the gaming session, the processing logic is configured to increase the RTP for the current stage.

7. The electronic, wager-based gaming device of claim 5, wherein the processing logic for determining is further configured to determine whether the current stage of the plurality of stages has been previously played by the player within a same day, when the current stage is determined to have been previously played by the player within the same day, the processing logic is configured to decrease the RTP for the current stage, and when the current stage is determined not to have been previously played by the player during the same day, the processing logic is configured to increase the RTP for the current stage.

8. The electronic, wager-based gaming device of claim 5, wherein the processing logic for determining is further configured to determine whether the current stage of the plurality of stages has an RTP that is less than a predetermined RTP, when the current stage is determined to have an RTP that is less than the predetermined RTP, the processing logic is configured to increase the RTP for the current stage, and when the current stage is determined to not have an RTP that is less than the predetermined RTP, the processing logic is configured to maintain the RTP unchanged for the current stage.

* * * * *